US009774069B2

(12) United States Patent
Crouch

(10) Patent No.: US 9,774,069 B2
(45) Date of Patent: Sep. 26, 2017

(54) N-WAY COAXIAL-TO-COAXIAL COMBINER/DIVIDER

(71) Applicant: Raytheon Company, Waltham, MA (US)

(72) Inventor: David D. Crouch, Corona, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/854,297

(22) Filed: Sep. 15, 2015

(65) Prior Publication Data

US 2017/0077577 A1 Mar. 16, 2017

(51) Int. Cl.
*H01P 5/12* (2006.01)
*H01P 3/06* (2006.01)
*H01Q 21/24* (2006.01)

(52) U.S. Cl.
CPC ..... *H01P 3/06* (2013.01); *H01P 5/12* (2013.01); *H01Q 21/245* (2013.01)

(58) Field of Classification Search
CPC ..... H01P 3/06; H01P 5/12; H01Q 21/245
USPC ..... 333/125, 124, 126–129
See application file for complete search history.

(56) References Cited

U.S. PATENT DOCUMENTS 2,822,525 A 2/1958 Casabona
3,091,743 A 5/1963 Wilkinson
4,035,746 A 7/1977 Covington, Jr.
4,605,902 A * 8/1986 Harrington ..... H01P 5/16 327/355
5,001,444 A 3/1991 Salvan et al.
5,010,348 A 4/1991 Rene et al.
(Continued)

OTHER PUBLICATIONS

Chang, et al.; "Millimeter-Wave Power-Combining Techniques;" IEEE Transactions on Microwave Theory and Techniques; vol. MTT-31; No. 2; Feb. 1983; pp. 91-107; 17 pages.
(Continued)

*Primary Examiner* — Robert Pascal
*Assistant Examiner* — Kimberly Glenn
(74) *Attorney, Agent, or Firm* — Daly, Crowley, Mofford & Durkee, LLP

(57) ABSTRACT

An impedance matching power combining/dividing system and a method for combining power combiners/dividers are presented. The impedance matching power combiner comprises a cylindrical matching cavity, two or more coaxial inputs, each of the two or more coaxial inputs having an inner input conductor and an outer input conductor and having a source impedance, a coaxial output having an inner output conductor and an outer output conductor and having a load impedance and a circular matching plate suspended inside the cylindrical matching cavity, wherein the inner input conductors and the inner output conductor are electrically connected to the matching plate, the outer input conductors and the outer output conductor are electrically connected to the cylindrical matching cavity and the cylindrical matching cavity at least partially matches the source impedance with the load impedance. The system and method to combine/divide groups of power combiners/dividers to handle high power are also presented. The power combiners/dividers have a small transverse dimension that they easily fit in a phased array lattice structure and operate at high frequencies.

18 Claims, 20 Drawing Sheets

(56) References Cited

U.S. PATENT DOCUMENTS

| | | | | |
|---|---|---|---|---|
| 5,142,253 | A | 8/1992 | Mallavarpu et al. | |
| 5,812,089 | A | 9/1998 | Locke | |
| 5,920,240 | A | 7/1999 | Alexanian et al. | |
| 6,344,777 | B1 | 2/2002 | Ingram et al. | |
| 7,113,056 | B2 | 9/2006 | Wu et al. | |
| 8,063,716 | B1 * | 11/2011 | Ives | H01P 5/12 333/125 |
| 8,427,382 | B2 | 4/2013 | Crouch | |
| 2004/0004522 | A1 | 1/2004 | Sweeney et al. | |
| 2010/0033272 | A1 | 2/2010 | O'Connell et al. | |
| 2014/0035697 | A1 | 2/2014 | Mohan et al. | |

OTHER PUBLICATIONS

De Villiers, et al.; "Design of a Ten-Way Conical Transmission Line Power Combiner;" IEEE Transactions on Microwave Theory and Techniques; vol. 55; No. 2; Feb. 2007; pp. 302-308; 7 pages.

Ingram, et al.; "Compact W-Band Solid-State MMIC High Power Sources;" WE4A-4; 2000 IEEE MTT-S Digest; pp. 955-958; 4 pages.

Pollak, et al.; "Compact Waveguide-Based Power Divider Feeding Independently Any Number of Coaxial Lines;" IEEE Transactions on Microwave Theory and Techniques; vol. 55; No. 5; May 2007; pp. 951-957; 7 pages.

Roy, et al.; "Novel N—Way Power Divider and Array Configuration for RFID Readers Operating at 5.8 GHz;" 2008 IEEE International Conference on RFID; Apr. 16-17, 2008; pp. 89-96; 8 pages.

Russel; "Microwave Power Combining Techniques;" IEEE Transactions on Microwave Theory and Techniques; vol. MTT-27; No. 5; May 1979; pp. 472-478; 7 pages.

PCT Search Report of the ISA for PCT/US2016/030527 dated Jul. 19, 2016; 6 pages.

PCT Written Opinion of the ISA for PCT/US2016/030527 dated Jul. 19, 2016; 9 pages.

de Villiers, et al.; "Design of a Ten-Way Conical Transmission Line Power Combiner," IEEE Transactions on Microwave Theory and Techniques; vol. 55; No. 2; Feb. 2007; pp. 302-308.

* cited by examiner

N-WAY COAXIAL-TO-COAXIAL COMBINER/DIVIDER

TECHNICAL FIELD

The present disclosure is generally directed to combiner and divider circuits for use at radio frequency (RF) and millimeter wave frequencies and more particularly to coaxial transmission line combiner/divider circuits.

BACKGROUND OF THE DISCLOSURE

A variety of combiner and divider circuits (combiner/divider circuits) operating over radio frequency (RF) and millimeter wave frequencies bands are known. One type of combiner/divider circuit often used in low power applications is a so-called Wilkinson power divider. Wilkinson power dividers are three-port devices provided from a pair of quarter-wavelength signal paths. A first end of each signal path is coupled to a first port and the second ends of each signal path correspond to the second and third ports. A signal fed to the first port is split with equal power and phase at the second and third ports. A resistive element is coupled between the quarter-wavelength signal paths. With this configuration, Wilkinson power dividers achieve isolation between the two output ports (i.e. the second and third ports in the above example) while maintaining a matched impedance condition at all ports. The quarter-wavelength signal paths can be implemented using printed circuit transmission lines, coaxial transmission lines or lumped element circuits. Since a Wilkinson power divider is made up of passive components, it is reciprocal and thus can also act as a power combiner. Thus, two signals having equal amplitude and phase fed to the second and third ports are combined at the first port.

There are power combiners that combine the outputs of multiple coaxial inputs into a single coaxial output. Some radial combiners are capable of providing high output power. However, these power combiners are typically multiple wavelengths in size at the RF frequencies of interest and are therefore incapable of supporting many applications where the power combiners must fit within a limited space such as within a lattice spacing of a phased array antenna.

Modern applications that require high RF power, also require efficiency in combining RF power using combiners. Matching a source impedance with that of an antenna has been a long standing problem for the RF power combiners in achieving this needed efficiency. In applications in which signals from a number of RF sources must be combined, impedance matching becomes a difficult problem to solve. The problem becomes increasingly more difficult with increasing numbers of signal sources. Thus, scalability in RF power combining has been a challenging problem.

Low loss performance over a wide bandwidth is a design requirement for many applications that use combiner circuits operating at RF frequencies. It is relatively difficult to provide power combiners/dividers which operate over a relatively wide RF bandwidth while at the same time having a relatively low insertion loss characteristic.

SUMMARY

To address one or more of the above-deficiencies of the prior art, the concepts described herein enable the manufacture of a compact, scalable combiner/divider system and method appropriate for use with any number of power sources to be combined and which is compact so as to be compatible with relatively small antenna element lattice spacings while at the same time providing an effective impedance match between multiple sources and a load (e.g. multiple RF signal sources and an antenna) over a wide frequency bandwidth. Furthermore, the scalable combiner/divider systems and techniques described herein are capable of operation at microwave and millimeter wave frequencies and thus scale in frequency as well as in the number of input and output ports as will become apparent from the description provided herein.

An embodiment of the impedance matching power combiner comprises a cylindrical matching cavity, two or more coaxial inputs, each of the two or more coaxial inputs having inner and outer input conductors having diameters selected to provide the coaxial inputs having a first predetermined impedance characteristic; a coaxial output includes inner and outer output conductors having diameters selected to provide the coaxial output having a second predetermined impedance characteristic and a circular matching plate disposed inside the cylindrical matching cavity. The inner conductors of the coaxial inputs and outputs are electrically coupled to the matching plate. The outer conductors of the coaxial inputs and output are electrically coupled to the cylindrical matching cavity. The cylindrical matching cavity at least partially matches the first impedance (e.g. a source impedance) with the second impedance (e.g. a load impedance). Thus, in applications in which RF signal sources are coupled to respective ones of the RF coaxial inputs, and a load is coupled to the RF coaxial output, the cylindrical matching cavity serves to at least partially impedance match the sources to the load.

The matching cavity is a coaxial cavity having an interior boundary corresponding to a conducting surface of the matching plate and having an exterior boundary corresponding to a conductive outer wall of the matching cavity. The matching cavity is also enclosed on the top and bottom by conductive cover plates that interface with the output and input coaxial transmission lines, respectively. The outer conductors of the input coaxial transmission lines connect to the bottom cover plate, and the outer conductor of the output coaxial transmission lines connects to the top cover plate.

In some embodiments, the cavity may be filled with insulating dielectric material (only the boundary surfaces are conductive). The following are representative materials which might be used; gasses: vacuum, air, sulfur hexafluoride, dry nitrogen; solids: PTFE (polytetrafluoroethylene), polypropylene, high-density polyethylene, FEP (fluorinated ethylene propylene); and/or liquids: transformer oil (e.g. Diala), Fluorinert (FC-70).

In one embodiment the matching plate is provided as a circular matching plate suspended inside the cylindrical matching cavity, which is at least partially filled with a dielectric material. Additionally, a system to connect groups of power combiners/dividers as well as connect power combiners/dividers for applications such as to drive antenna elements in a phased array is described herein. A system of impedance matching power combiners may be provided by coupling two or more power combiners with each power combiner comprising a cylindrical matching cavity and two or more coaxial inputs and a coaxial output.

Certain embodiments may provide various technical advantages depending upon the implementation. For example, a technical advantage of some embodiments may include the ability to combine several of the power combiners/dividers, while still fitting within a compact area (e.g. a tight lattice spacing of a phased array antenna). Certain other embodiments may provide for scalability of combining/dividing power sources where the scalability factor N can be any number and is not necessarily multiples of two or powers of two.

Although specific advantages have been enumerated above, various embodiments may include some, none, or all of the enumerated advantages. Additionally, other technical advantages may become readily apparent to one of ordinary skill in the art after review of the following figures and description.

In accordance with the concepts, systems, circuits and techniques described herein, a coaxial-to-coaxial RF combiner/divider includes a matching cavity, a matching plate disposed inside the matching cavity, two or more coaxial inputs disposed on one end of the cavity and a coaxial output disposed on an end of the cavity opposite the coaxial inputs. The coaxial inputs and outputs are electrically coupled to both the matching cavity and matching plate.

Each of the two or more coaxial inputs are provided having a characteristic impedance selected to match a characteristic impedance of an input device coupled thereto (e.g. an RF signal source) and the coaxial output is provided having a characteristic impedance selected to match a characteristic impedance of a load impedance (e.g. an RF antenna). The cylindrical matching cavity and matching plate operate to at least partially match the source impedance with the load impedance.

With this particular arrangement, a coaxial-to-coaxial RF power combiner/divider having a relatively low insertion loss characteristic over a relatively large RF bandwidth is provided. By providing a cavity structure which operates to at least partially match the source impedance with the load impedance and a matching plate to which multiple coaxial signal paths can be coupled, the coaxial-to-coaxial RF power combiner/divider is scalable to a desired number of sources to be combined.

Thus, the coaxial-to-coaxial RF combiner/divider described herein addresses bandwidth, insertion loss and scalability issues and thus allows system architects to use multiple sources (e.g. multiple low power or high power microwave sources) in desired applications. Furthermore, the coaxial-to-coaxial RF combiner/divider described herein is provided having a low insertion loss characteristic over a wide bandwidth while at the same time providing an impedance match between input and output ports. Thus, the impedance of multiple RF signal sources may be matched, for example, to that of an RF antenna (or other RF load) so as to provide improved power transfer efficiency and minimize reflections for signals provided from the signal source to the antenna (or other load).

A variety of high-power microwave prior art systems are known and such systems typically utilize a single microwave power source and radiate RF signals from a single antenna. Such use of a single high power microwave source constrains the system architecture for many applications making it inflexible and not conducive for applications such as modern phased array antennas or in electronic beam steering applications.

As noted above, however, the coaxial-to-coaxial RF combiner/divider described herein has an impedance matching characteristic and thus enables use of a plurality of signal sources the outputs of which can be combined to provide a high power signal which in turn can be distributed among individual antenna elements of an array antenna. Thus, the power radiated by each antenna element is generated by combining the output signals provided from a large number of RF sources. In some embodiments, it may be desirable to combine the outputs of a large number of RF sources each of which provides an RF signal having a relatively low signal power level. In this way, a high power RF signal source can be made from a plurality of low power signal sources. This is in contrast to the prior art approach of utilizing a single high power microwave source.

As will be appreciated by those of ordinary skill in the art, what may be considered "high power" or "low power" depends upon the particular application and frequency of operation as well as on the current state of the art. At frequencies of about 1 GHz, for example, a signal having a peak power of 1 KW or greater may be considered high power. In this case, several RF signal sources may be combined to provide such a high power output signal. On the other hand, at millimeter wave frequencies, a high power signal might be on the order of 10 watts and a plurality of RF signal sources may be combined to provide such a high power signal.

Combining the outputs of a plurality of RF sources (e.g. two or more relatively low power RF sources) results in advancements in a wide variety of commercial and non-commercial technology areas including, but not limited to, the areas of Phased Array Antennas, Directed Energy/High Power Microwave applications and Electronic Warfare and industrial RF heating.

BRIEF DESCRIPTION OF THE DRAWINGS

For a more complete understanding of the present disclosure and its advantages, reference is now made to the following description taken in conjunction with the accompanying drawings, in which like reference numerals represent like parts.

11A is a block diagram of an RF system which utilizes a plurality of coaxial RF power combiners/dividers.

DETAILED DESCRIPTION

It should be understood at the outset that, although example embodiments are illustrated below, the power combining/dividing circuits and concepts described herein may be implemented using any number of techniques, whether currently known or not. The concepts described herein should in no way be limited to the example implementations, figures, and techniques illustrated below. Additionally, the drawings are not necessarily drawn to scale.

It should also be appreciated that although reference is sometimes made herein below to a coaxial radio frequency (RF) power combiner/divider having a specific number of ports (e.g. "ten input ports") such reference is made only to promote clarity in the description and drawings. After reading the disclosure provided herein, those of ordinary skill in the art will appreciate that a coaxial RF power combiner/divider having any number of ports may be fabricated using the concepts and techniques described herein. For example, an N:1 combiner (or 1:N divider) where N is an integer greater than 1 may be fabricated. It should also be appreciated that the terms "input" and "output" are used herein as a matter of convenience and to promote clarity in the description. It should be understood that the coaxial RF power combiner/divider described herein is reciprocal (i.e. depending upon use in a particular application, inputs may sometimes act as outputs and outputs may sometimes act as inputs). Thus, the structures described herein can act either as a coaxial-to-coaxial RF divider circuit or as a coaxial-to-coaxial RF combiner circuit.

It should be appreciated that although the reference is sometimes made herein to a combiner matching the impedance of a source to that of a load, those of ordinary skill in the art will appreciate, that in many practical systems, this is not the case and that in a number of systems the source and load will incorporate matching circuitry to match its impedance to that of the adjoining transmission line (with 50 ohms being a common choice). Coaxial transmission lines have their own characteristic impedances that are determined by the radii of the inner and outer conductors and the dielectric constant of the insulation separating them. It should also be appreciated that with reference to combiners/dividers, as used herein the phrase "input impedance" is interchangeable with "source impedance" and "output impedance" is interchangeable with "load impedance." The combiner combines multiple inputs from input coaxial transmission lines having one characteristic impedance (the "input impedance") and delivers the combined input power to a single output coaxial transmission line having a second characteristic impedance (the "output impedance") which can be the same as or different from the input impedance).

Figure 1:
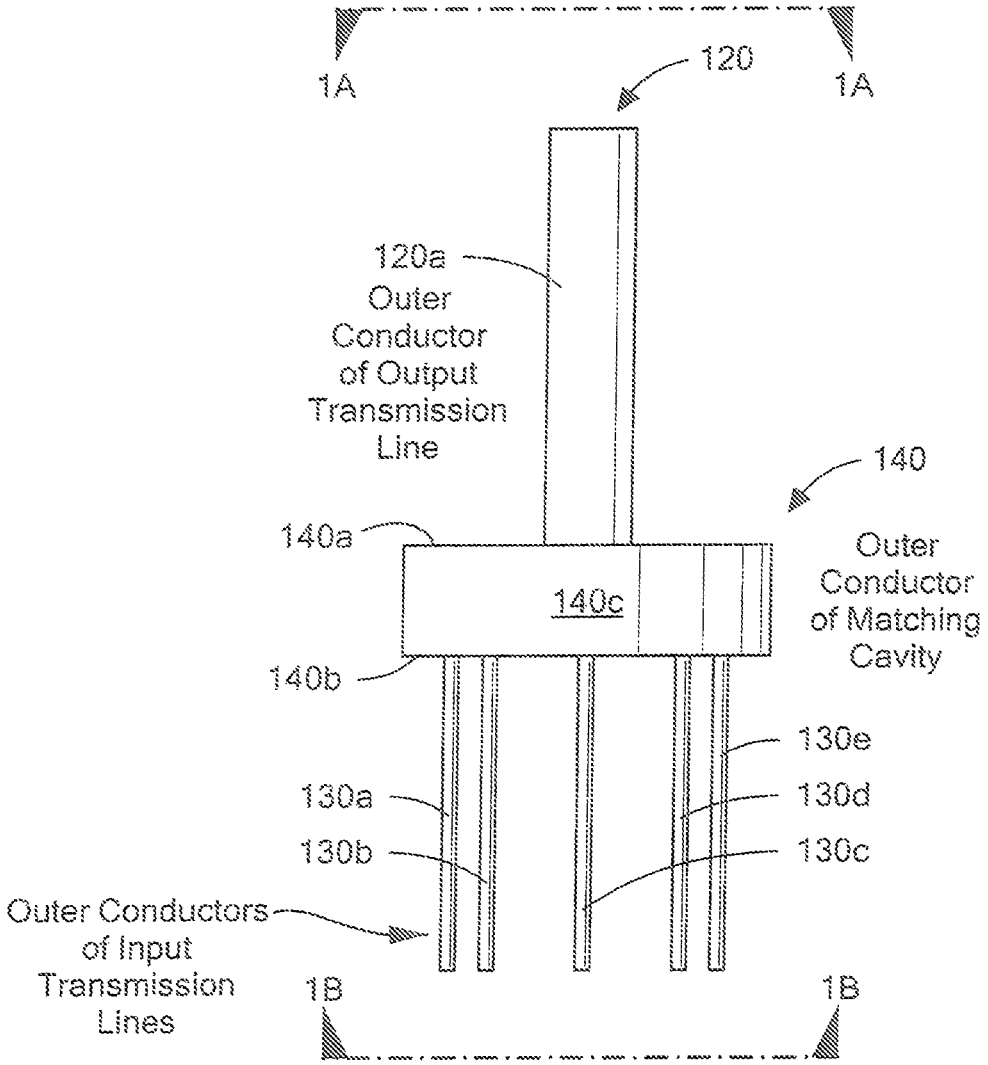
FIG. 1 is a side view of a coaxial radio frequency (RF) power combiner/divider.
Figure 1A:
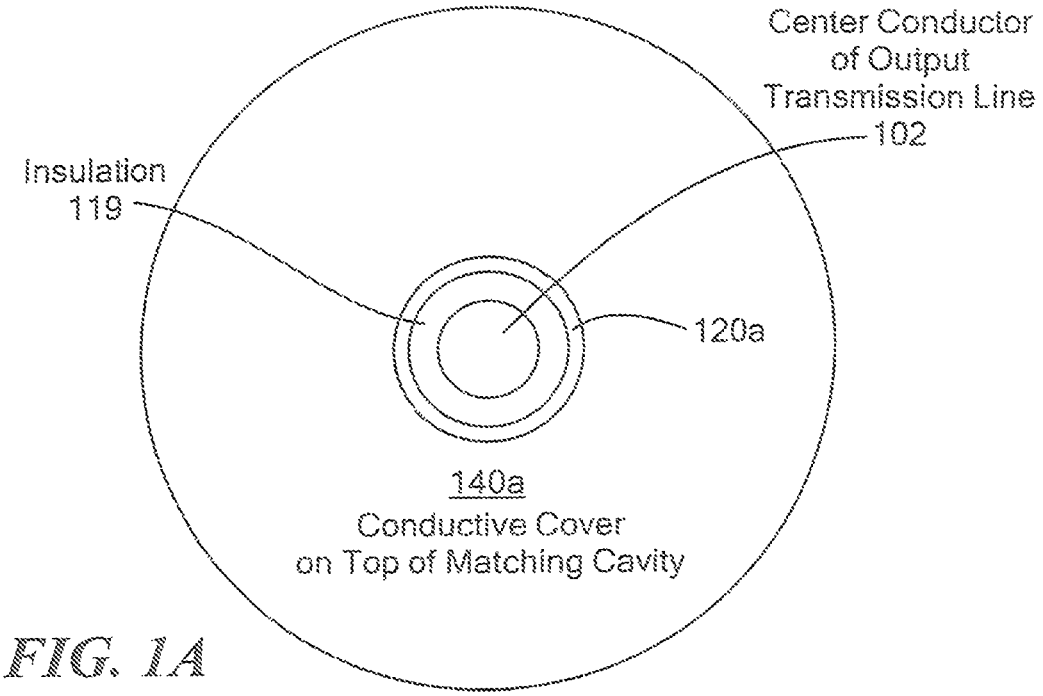
FIG. 1A is a top view of the coaxial RF power combiner/divider of FIG. 1 taken across lines 1A-1A in FIG. 1.
Figure 1B:
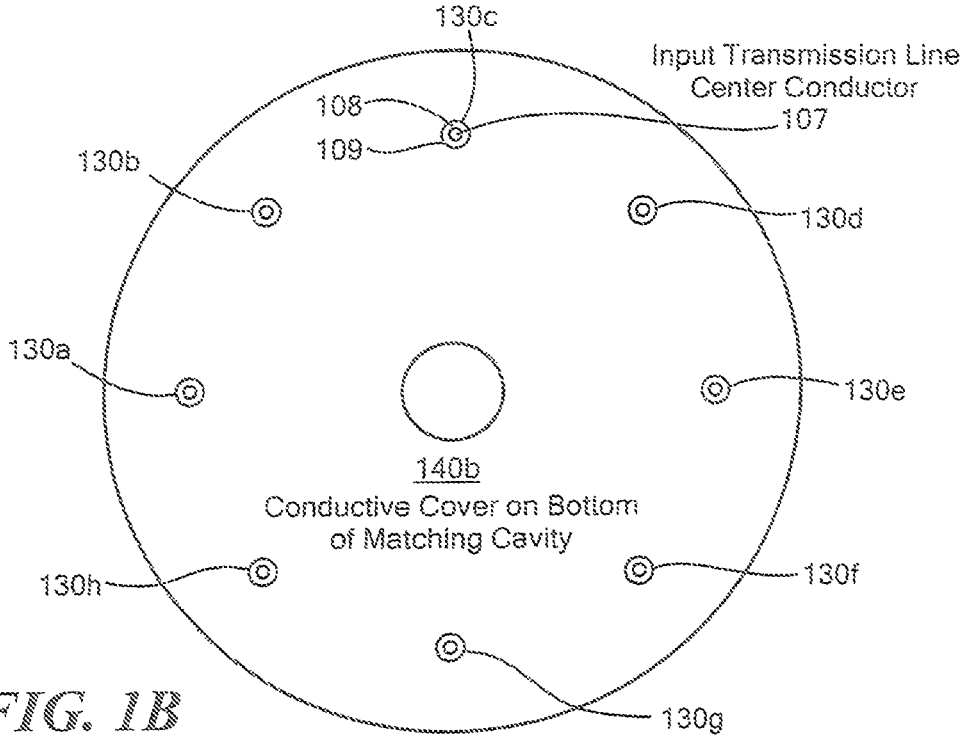
FIG. 1B is a bottom view of the coaxial RF power combiner/divider of FIG. 1 taken across lines 1B-1B in FIG. 1.
Figure 1C:
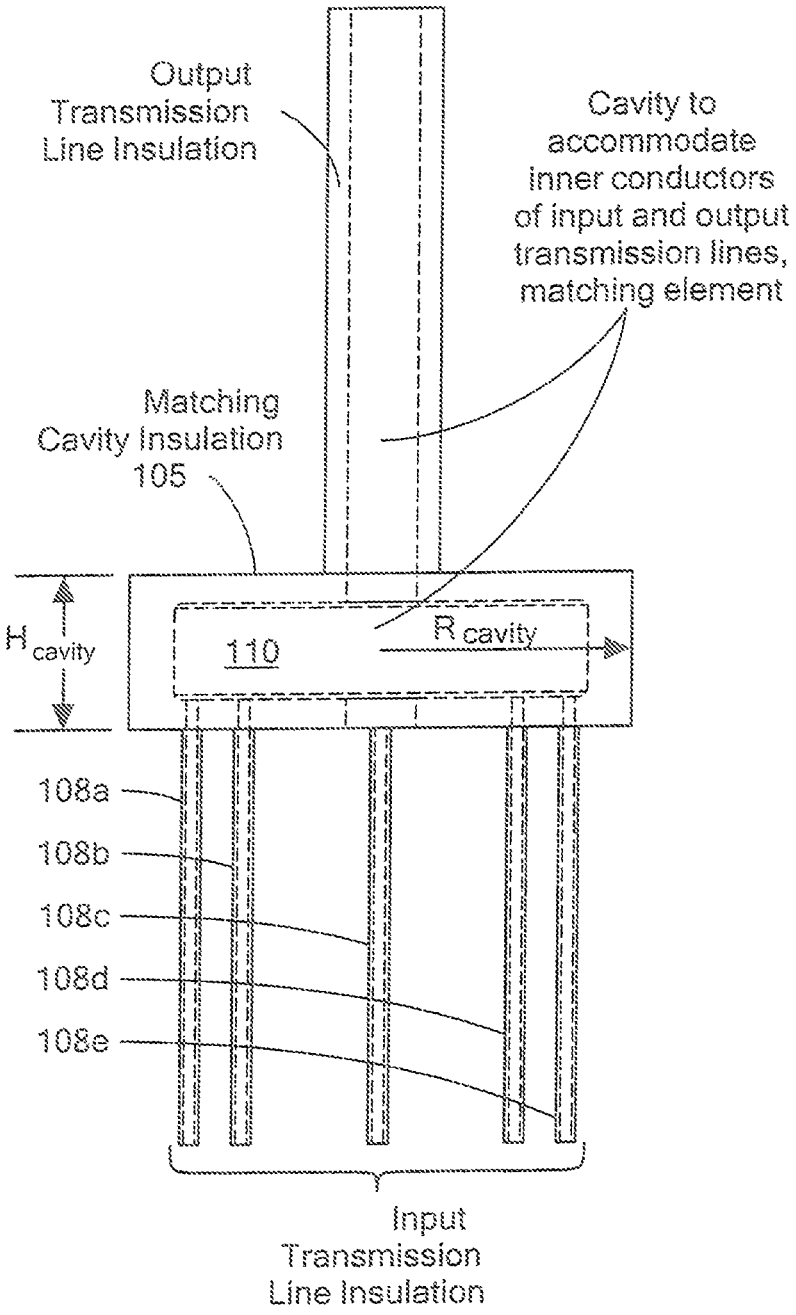
FIG. 1C is a side view of the coaxial RF power combiner/divider of FIG. 1 having the outer conductors removed to reveal dielectric portions of the coaxial RF power combiner/divider circuit.
Figure 1D:
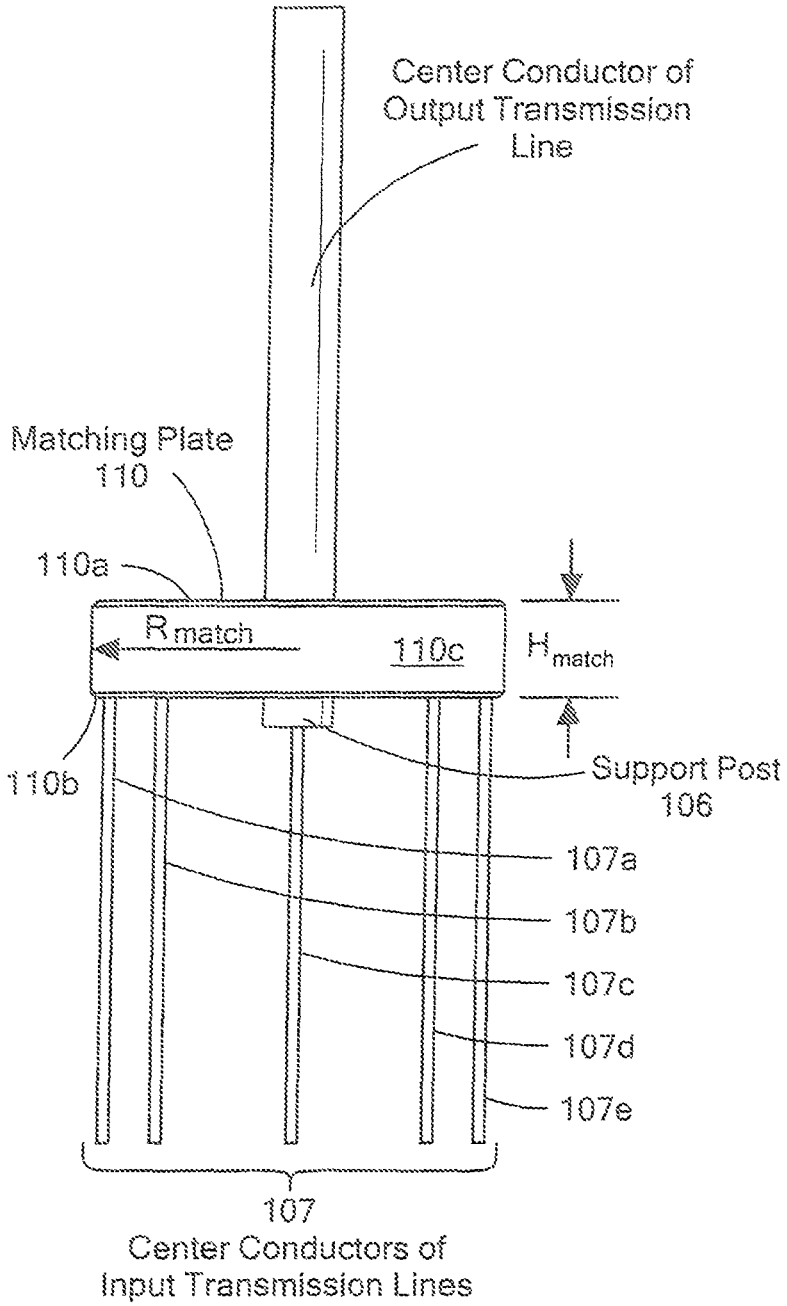
FIG. 1D is a side view of the coaxial RF power combiner/divider circuit of FIG. 1 having both the outer conductor (FIG. 1) and dielectric portions (FIG. C) removed to reveal internal portions of the RF power combiner/divider not visible in FIGS. 1A-1C.

Referring now to FIGS. 1-1D, in which like elements are provided having like reference designations throughout the several views, a coaxial radio frequency (RF) power combiner/divider 100 includes a plurality of coaxial inputs, here eight (8) inputs 130*a*-130*h*, and a coaxial output 120.

In the illustrative embodiment of FIG. 1, the inputs 130*a*-130*h* and output 120 are each provided as coaxial transmission lines.

A cylindrical matching cavity 140 has top and bottom surfaces 140*b* and a side surface 140*c*. Matching cavity surface 140*a* is sometimes referred to herein as a top cover plate or a conductive cover 140*a* on top of cavity 140. Similarly, matching cavity surface 140*b* is sometimes referred to herein as a bottom cover plate or a conductive cover 140*b* on a bottom of cavity 140. Coaxial transmission lines 130*a*-130*h* are coupled to the bottom surface 140*b* of cylindrical matching cavity 140.

For convenience and ease of description, coaxial transmission lines 130*a*-130*h* will sometimes be referred to herein as "coaxial input lines 130" or more simply as "inputs" or "inputs 130." Although eight lines 130 are shown in the illustrative embodiment of FIGS. 1-1D, in general N lines 130 may be used (where N is an integer greater than 1).

The single coaxial transmission line 120 is coupled to second end of cavity 140 at top surface 140*a*. For convenience and ease of description, coaxial line 120 will sometimes be referred to herein as an "output" or "output 120." It should be appreciated that the concepts described herein rely on cylindrical symmetry and thus each of the N input/output lines on one end are equivalent electrically and geometrically. It should, however, also be appreciated that in some embodiments, the inputs and the output may be on the same end of the cavity.

And as noted above, although coaxial lines 130*a*-130*j* are sometimes referred to herein as inputs and coaxial line 120 is sometimes referred to herein as an output, those of ordinary skill in the art will appreciate, that since coaxial circuit 100 may function as either a power divider or a power combiner, coaxial line 120 may sometimes act as an input of circuit 100 and the coaxial lines 130 may sometimes act as outputs of circuit 100.

Center conductors 107 of the input coaxial transmission lines 130*a*-130*h* extend through openings in the bottom surface 140*b* of cavity 140. The diameter of each opening in surface 140*b* is equal to the inside diameter of the outer conductor 109 of the corresponding input coaxial transmission lines 130*a*-130*h*.

Each input coaxial line 130, includes an inner or center conductor 107, an outer conductor 109, insulation 108 disposed between the inner and outer conductors 107, 109.

Outer conductor 109 of each input coaxial transmission line 130*a*-130*h* is rigidly attached to and makes good electrical contact with the bottom cover 140*b* of the cylindrical matching cavity 140. The inner conductor 107 of each coaxial transmission line 130 extends through the corresponding opening and is rigidly attached to and makes good electrical contact with a circular metal matching plate 110 (FIGS. 1C, 1D) disposed inside the cavity region defined by the inner conductive surfaces of the cylindrical matching cavity 140. Matching plate 110 is provided having a top surface 110*a*, a bottom surface 110*b* and side surfaces 110*c*. Top and bottom surfaces 110*a*, 110*b* are spaced apart by a distance $H_{match}$ (i.e. the distance $H_{match}$ corresponds to the height of side surfaces 110*c*). Also, matching plate 110 is provided having a radius $R_{match}$. Matching plate 110 is disposed inside matching cavity 140. Since the radius $R_{cavity}$ of cavity 140 is greater than the matching plate radius $R_{match}$, the surfaces 110*c* of matching plate 110 are spaced apart from the inner conductive surfaces of cavity walls 140*a*, 140*b*, 140*c*. Thus, conductive surfaces of matching plate 110 do not directly contact conductive surfaces of cavity 140. A central longitudinal axis of the matching plate 110 is aligned with a central longitudinal axis of the matching cavity 140. The matching plate 110 is thus symmetrically disposed within the matching cavity 140.

Additional mechanical support may be provided by a metal post 106 (FIG. 1D) rigidly attached between the center of the bottom matching cover plate 110*b* and the center of the matching cavity 140 (FIGS. 1C, 1D). The cavity defined by the inner surfaces of matching cavity walls—140*a*, 140*b*, 140*c* may be partially or fully filled with a suitable dielectric/insulating material 105 (also sometimes referred to herein as "cavity insulation 105"). Insulating material 105 may be provided from any suitable dielectric such as Teflon®.

At the opposite end of the cavity, the center (inside) conductor 102 of the output coaxial transmission line 120 extends through top surface 140*a* of matching cavity 140. The center conductor of the output coaxial transmission line extends through an opening in the top cover plate 140*a* of the matching cavity 140 and terminates on surface 110*a* of matching plate 110.

The diameter of the opening in surface 140*a* is equal to the inside diameter of the outer conductor 120*a* of the output coaxial transmission line 120. Insulation 119 is disposed between a center (inside) conductor 102 and the outer conductor 120*a* of the output coaxial line 120. Insulation 119 may be provided from any suitable material known to those of ordinary skill in the art. The outer conductor 120*a* of the output coaxial transmission line 120 is rigidly attached to and makes good electrical contact with the top cover matching plate 140*a* of the cylindrical cavity 140. As noted above the inner conductor 102 of the output coaxial transmission line 120 extends through the opening in top cover 140*a* and is rigidly attached to and makes good electrical contact with the top surface 110*a* of the circular metal matching plate 110.

The input and output coaxial lines 120, 130 can be provided from any suitable commercially available coaxial lines. However, in some embodiments, custom coaxial lines may also be used and the cavity insulation 105 can be of any suitable insulating material The matching plate 110 as well as the side wall of the matching plate 104, and the top and bottom cover matching pates can be of any suitable conductive material, such as copper or any alloys used as electrically conducting material.

The cavity 140 and matching plate 110 function as a quarter-wave transformer that match the effective impedance of the parallel input lines 130 to that of the output line 120. That is, the cavity and matching plate function as the outer and inner conductors of a quarter-wave impedance-matching transformer.

At the input 120, the power combiner combines the outputs of N input lines each of characteristic impedance $Z_{in}$, since the inputs are in parallel, their effective impedance is $Z_{in}/N$. If the characteristic impedance of the output transmission line 120 is $Z_{out}$, then the characteristic impedance of the quarter-wave matching section (the cavity 140) is approximately $$Z_{match} \approx \sqrt{\frac{Z_{in}Z_{out}}{N}}. \tag{1}$$

The characteristic impedance of a transmission line having inner conductor radius $R_{match}$ and outer conductor radius $R_{cavity}$ (see FIGS. 1C, 1D) is $$Z_{match} = \frac{60\ \Omega}{\sqrt{\varepsilon_R}} \ln\left(\frac{R_{cavity}}{R_{match}}\right)$$

The ratio of the outer to inner conductor diameters of the quarter-wave matching section then is $$\frac{R_{cavity}}{R_{match}} \approx \exp\left(\frac{Z_{match}\sqrt{\varepsilon_R}}{60\ \Omega}\right). \tag{2}$$

The length of the quarter-wave matching section is approximately the height of the cavity plus the radius of the center conductor; therefore $$H_{cavity} - R_{match} \approx \frac{\lambda_0}{4\sqrt{\varepsilon_R}} \tag{3}$$

where $\lambda_0$ is the wavelength in free space. The centers of the input transmission lines $\mathbf{130}_A$ through $\mathbf{130}_N$ are equally spaced on a circle of radius $R_{input}$, which is only slightly less than $R_{match}$, the radius of the matching plate 110; that is, as an initial estimate $$0.8R_{match} \leq R_{input} \leq 0.9R_{match}. \tag{4}$$

Equations (1)-(4) provide guidelines with which to choose a reasonable starting point for a design optimization. Given the number of inputs to be combined and the impedances of the input and output transmission lines, one approach is to choose an initial value for the matching-cavity radius $R_{cavity}$, and using Equation (2) to determine the starting value of the matching element radius $R_{match}$, and Equation (3) determines the initial cavity height $H_{cavity}$. One of ordinary skill in the art will appreciate that there are several other approaches possible to determine the cavity design parameters from Equations (1)-(4) and the concepts described in this patent application include all such approaches.

An embodiment of this power combiner/divider was designed using the approach described above for operation at a center frequency of 1 GHz and with eight input ports (N=8). At a frequency of 1 GHz and for a dielectric material having a relative dielectric constant ($\in_R$=2.1), and with the inputs having a characteristic impedance of 30 ohms and the output having a characteristic impedance of 20 ohms, $$Z_{match} = 8.66\ \Omega,$$

$$\frac{R_{cavity}}{R_{match}} \approx \exp\left(\frac{Z_{match}\sqrt{\varepsilon_R}}{60\ \Omega}\right) = 1.233,$$

$$H_{cavity} + R_{match} \approx \frac{\lambda_0}{4\sqrt{\varepsilon_R}} = 2.04.$$

(dimensions are inches, i.e., 2.04")

If $R_{cavity}$=1.5", then $R_{match}$=1.2" and let $H_{cavity}$=1.2". With this as a starting point, the dimensions of the optimized combiner are $R_{cavity}$=1.74", $H_{cavity}$=1.09", $R_{match}$=1.44". It must be noted that a different starting point will yield a different optimized design. These guidelines provide a reasonably good starting point, and also provide insight as to how different parameters interact. For example, if it is desired to reduce the radius of the combiner, Equation (3) tells us that the height of the combiner will likely grow.

Figure 2:
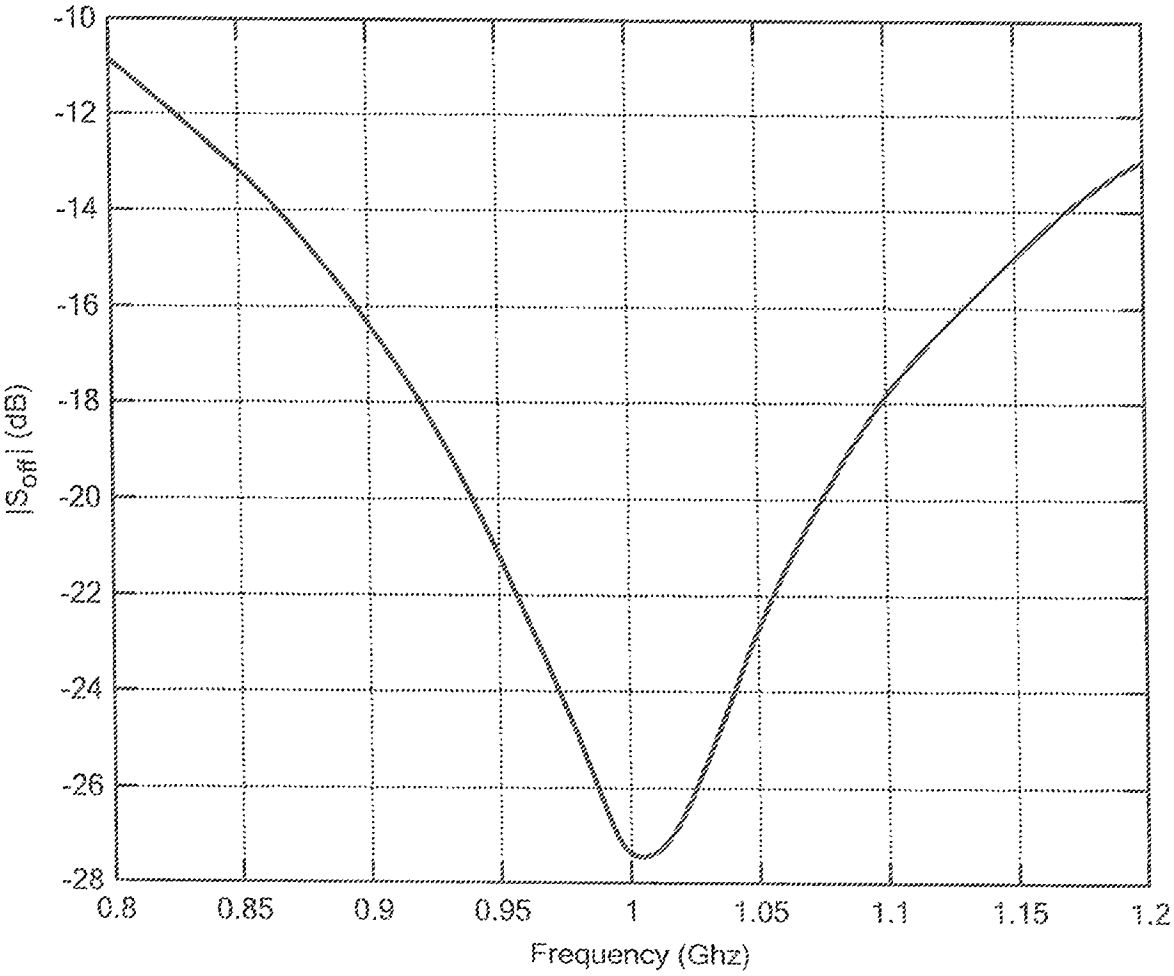
FIG. 2 is a plot of return loss versus frequency according to an embodiment which is the same as or similar to the coaxial RF power combiner of FIG. 1.

Referring now to FIG. 2, a plot of effective return loss ($S_{off}$) versus frequency, illustrates performance of an eight-way coaxial RF combiner/divider which may be the same as or similar to the coaxial RF combiner/divider of FIG. 1. The effective reflection coefficient at the input port with index 1 may be computed as:

$$S_{eff}=S_{11}+S_{12}+S_{13}+S_{14}+S_{15}+S_{16}+S_{17}+S_{18}.$$

in which:

$S_{11}$ is a reflection coefficient at the input port with index 1 (e.g. port 130*a* in FIG. 1);

$S_{12}$ is a transmission coefficient between the input port with index 1 (e.g. port 130*a* in FIG. 1) and an input port with index 2 (e.g. port 130*b* in FIG. 1);

$S_{13}$ is a transmission coefficient between the input port with index 1 (e.g. port 130*a* in FIG. 1) and an input port with index 3 (e.g. port 130*c* in FIG. 1);

$S_{14}$ is a transmission coefficient between the input port with index 1 (e.g. port 130*a*20 in FIG. 1) and an input port with index 4 (e.g. port 130*d* in FIG. 1);

$S_{15}$ is a transmission coefficient between the input port with index 1 (e.g. port 130*a* in FIG. 1) and an input port with index 5 (e.g. port 130*e* in FIG. 1);

$S_{16}$ is a transmission coefficient between the input port with index 1 (e.g. port 130*a* in FIG. 1) and an input port with index 6 (e.g. port 130*f* in FIG. 1);

$S_{17}$ is a transmission coefficient between the input port with index 1 (e.g. port 130*a* in FIG. 1) and an input port with index 7 (e.g. port 130*g* in FIG. 1);

$S_{18}$ is a transmission coefficient between the input port with index 1 (e.g. port 130*a* in FIG. 1) and an input port with index 8 (e.g. port 130*h* in FIG. 1).

The indices 1-8 refer to the eight input ports when the device is used as an 8:1 combiner. In this mode of operation, the eight input ports will be coupled together. $S_{13}$, for example, is the transmission coefficient between input port 3 and input port 1; it quantifies the portion of the signal incident on port 3 that is coupled out of port 1 and adds to the total power "reflected" from port 1. The total reflected power when all inputs are of the same amplitude, phase and frequency is $S_{eff}$. If the complex amplitude of the input signal at a single port is A exp(iϕ), where A is the signal amplitude and ϕ is its phase, the complex reflected signal amplitude from any of the input ports (since they are all electrically equivalent) is $S_{eff}$ A exp(iϕ).

Because all inputs are geometrically equivalent and because all inputs are fed in phase, the effective reflection coefficient $S_{eff}$ is the same for all eight (8) inputs. Also, note that the cross-coupled components can be made to cancel directly-reflected components over a substantial bandwidth. For a given impedance transformation ratio, bandwidth decreases if the cavity radius $R_{cavity}$ is made too small.

As shown in FIG. 2, an eight (8) port power combiner having small transverse dimensions (diameter<λ/4) can achieve bandwidth over 35% while still limiting return loss to less than −10 decibels (dB)—i.e. $S_{11}$<−10 dB. The physical dimensions can be adjusted to achieve a high return loss at a center frequency and reduced peak electric field level. The relatively small transverse dimensions make the coaxial RF power combiner/divider compatible with phased array lattice spacing at these high frequencies.

Figure 3:
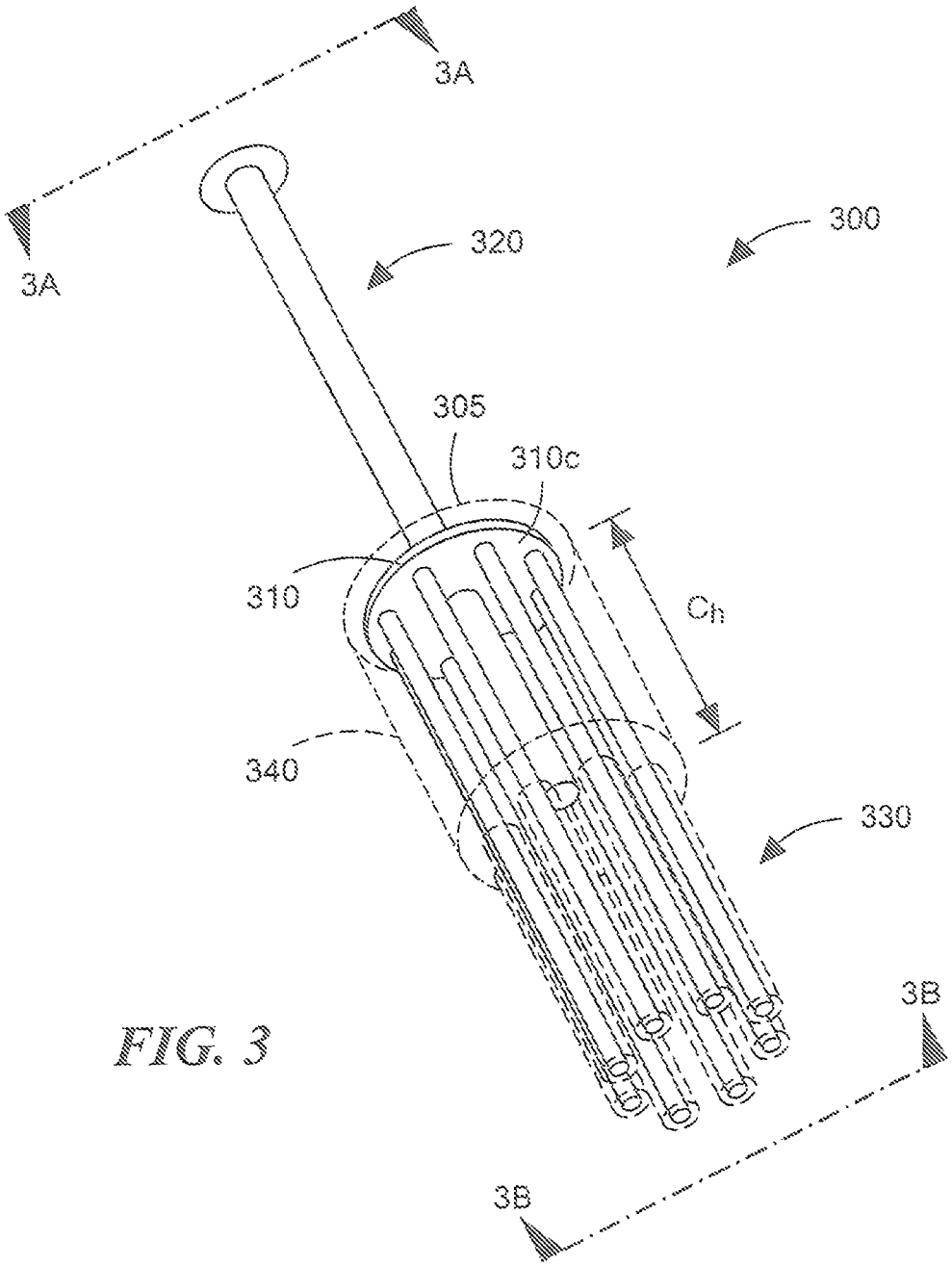
FIGS. 3 and 3A-3B illustrate an air filled coaxial RF power combiner/divider having portions removed to reveal internal structures according to an embodiment of the present disclosure.
Figure 3A:
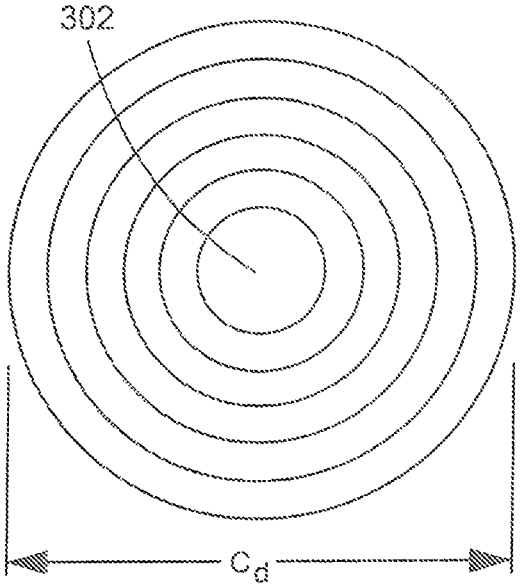
Figure 3B:
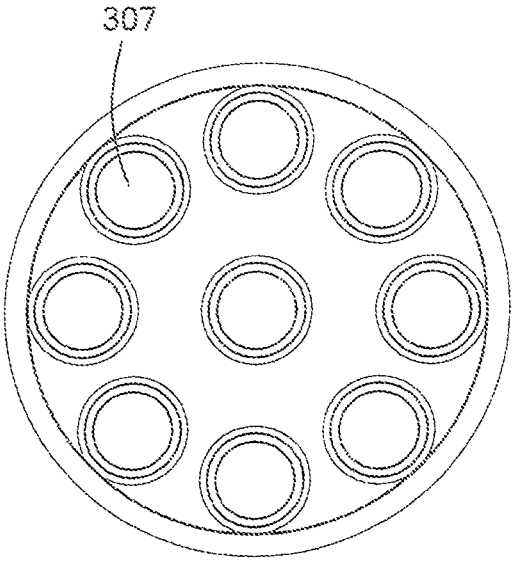

Referring now to FIGS. 3-3B in which like elements are provided having like reference designations throughout the several views, another embodiment of an impedance transforming eight port power combiner/divider 300 illustrates center conductors 307 of input ports 330 connected to a matching plate 310 located inside a matching cavity 340. The matching cavity is illustrated in phantom 50 as to reveal matching plate 310 (not visible in FIGS. 3-3B). A center conductor 302 of output coaxial line 320 is also connected to the matching plate 310. It should be appreciated that in the embodiment of FIGS. 3-3B, matching plate 310 is relatively short (i.e. the height of the sidewalls 310C of matching plate 310 are relatively short compared with the height of side walls 110*c* of matching plate 110 in FIG. 1D) but is otherwise architecturally similar to the coaxial RF combiner/dividers previously discussed herein in conjunction with FIGS. 1-2.

It should be appreciated that the matching plate 310 need not be at the center of the matching cavity. In the example of embodiment of FIG. 3, the matching plate 310 is located near the top of the matching cavity. While Equations (1)-(4) provide design guidelines that determine a good starting point, it should be appreciated that they do not necessarily determine matching plate location. Placement of the matching plate is determined by the optimization process where the goal is typically to achieve a minimum return loss over a desired bandwidth. In very high power applications, lower bounds may be placed on the distance between the matching plate and the top and bottom conductive covers of the cavity to avoid excessive electric field amplitudes which can lead to dielectric breakdown.

A dielectric material (e.g. insulation or other non-conductive material) may be disposed inside the matching cavity, to fully or partially fill the volume between the surface of the matching plate and the inside surface of the matching cavity. The use of dielectric to at least partially fill the cavity is warranted when power levels are so high that the associated peak electric fields can lead to air breakdown (i.e., the electric fields strip electrons off atoms, creating a conductive plasma). This can occur when peak electric fields are in the range of 20-30 kV/cm. The factors considered in selecting a dielectric are dielectric strength (what is the maximum electric field it can withstand without breaking down) and loss tangent. The dielectric constant SR is typically chosen to be comparable to that used in standard coaxial transmission lines, i.e, Teflon ($\in_R$=2.1) or polyethylene ($\in_R$=2.4). Low SR materials are typically polymers and are easy to fabricate to the required shape, another desirable feature.

The input and output coaxial lines can be any suitable commercially available coaxial lines or alternatively may be provided as custom coaxial lines are also an option and the cavity insulation can be of any suitable insulating material such as Teflon®. The matching plate 310 can be of any suitable conductive material, such as copper or any alloys used as electrically conducting material.

Figure 4:
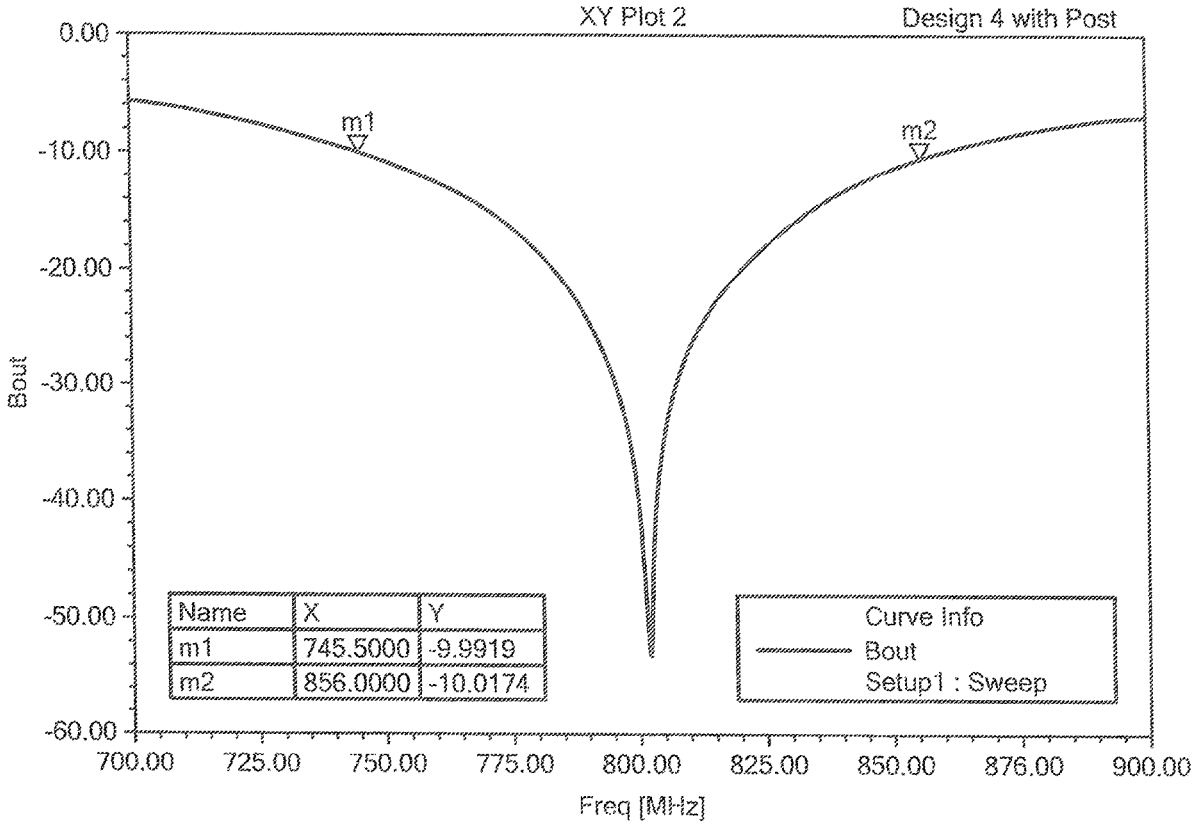
FIG. 4 is a plot of return loss versus frequency at an output of a coaxial RF power combiner provided according to an embodiment of the present disclosure.

In one illustrative embodiment, a power combiner similar to power combiner 300 was designed to operate at a center frequency of 800 MHz and its simulated performance curve is illustrated in FIG. 4. The characteristic impedance of each input in the coaxial transmission lines 330 is 10Ω, and that of the output coaxial transmission line 320 is 50Ω. All transmission lines are air-filled (with an air dielectric used for simplicity) as is the cavity. If power levels are high, but not so high as to cause air breakdown, air dielectric is advantageous due to its low loss (its loss tangent is nearly zero). The input coaxial lines have an inner conductor diameter of 0.422" and an outer conductor with an inside diameter of 0.50". The centers of the input transmission lines lie on a circle 1.88" in diameter. The cylindrical cavity is 2.5" in diameter and 3.31" in height. The matching plate is 0.125" thick and 2.3" in diameter. The matching plate is positioned approximately 2.986" from the bottom of the cavity, and is supported by a conductive support post having a diameter of about 0.5". The dimensions of the support post should be selected such that the post diameter is significantly smaller than the diameter of the circle on which the input transmission lines lie The output coaxial transmission line has inner and outer conductor diameters of 0.434" and 1.0", respectively.

In FIG. 4, the plotted quantity $S_{out}$ is the effective return loss, which is used as a figure of merit. The effective return loss is a measure of the reflected signal amplitude when all input ports are energized with equal amplitude and phase.

$$S_{out}=20\log_{10}(|S_{11}+S_{12}+S_{13}+S_{14}+S_{15}+S_{16}+S_{17}+S_{18}|)$$

It can be observed from FIG. 4 that the effective return loss is below −10 dB over a 13.8% bandwidth (with respect to the 800 MHz center frequency) extending from 745.5 MHz to 856 MHz for the illustrated example of the power combiner 300.

Power combiners provided in accordance with the concepts described herein serve equally well as power dividers. In this role, the input end of the power combiner is the output end of the power divider, and the output end of the power combiner is the input end of the power divider. For example, the eight-way power combiner/divider shown in FIG. 3-3B can be used without modification as a one-to-eight way power divider. Power delivered to the single-input end of the combiner/divider is divided among the eight outputs with equal amplitude and phase.

Figure 5:
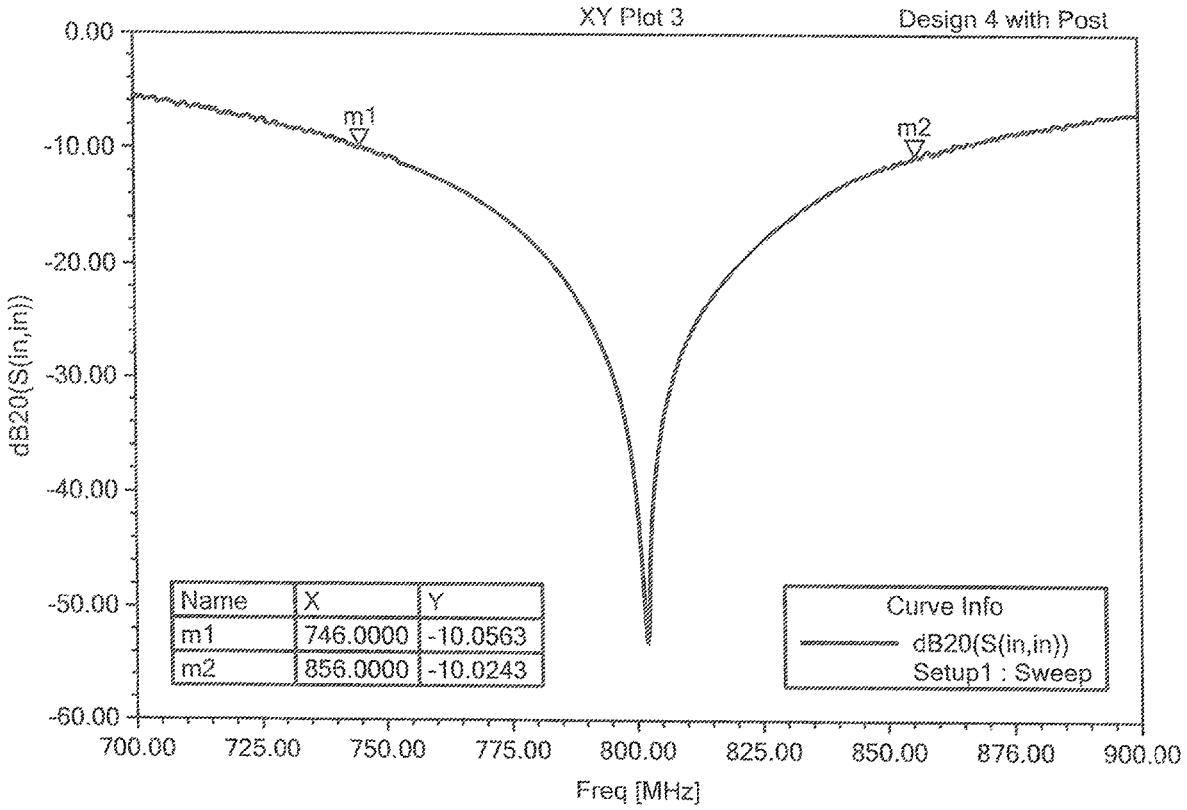
FIG. 5 is a plot of return loss versus frequency at an input port of a power divider/combiner according to an embodiment of the present disclosure.

FIG. 5 illustrates performance of an eight-way air-filled coaxial power combiner/divider which may be the same as or similar to divider/combiner 300 described above in conjunction with FIGS. 3-3B, when operated as a power divider. Plotted is the return loss ($S_{In,In}$) seen looking into the power divider input. As can be observed from FIG. 5, $|S_{In,In}|<-10$ dB between 745.5 and 856 MHz, yielding a 13.8% bandwidth with respect to the 800 MHz center frequency.

Comparing this power divider with the power combiner of FIG. 4 shows the two to be nearly identical, so the bandwidth of the power divider is the same as that of the power combiner. Comparable results will be observed for N-way combiners in general, i.e., they will operate equally well as power dividers without modification.

Figure 6:
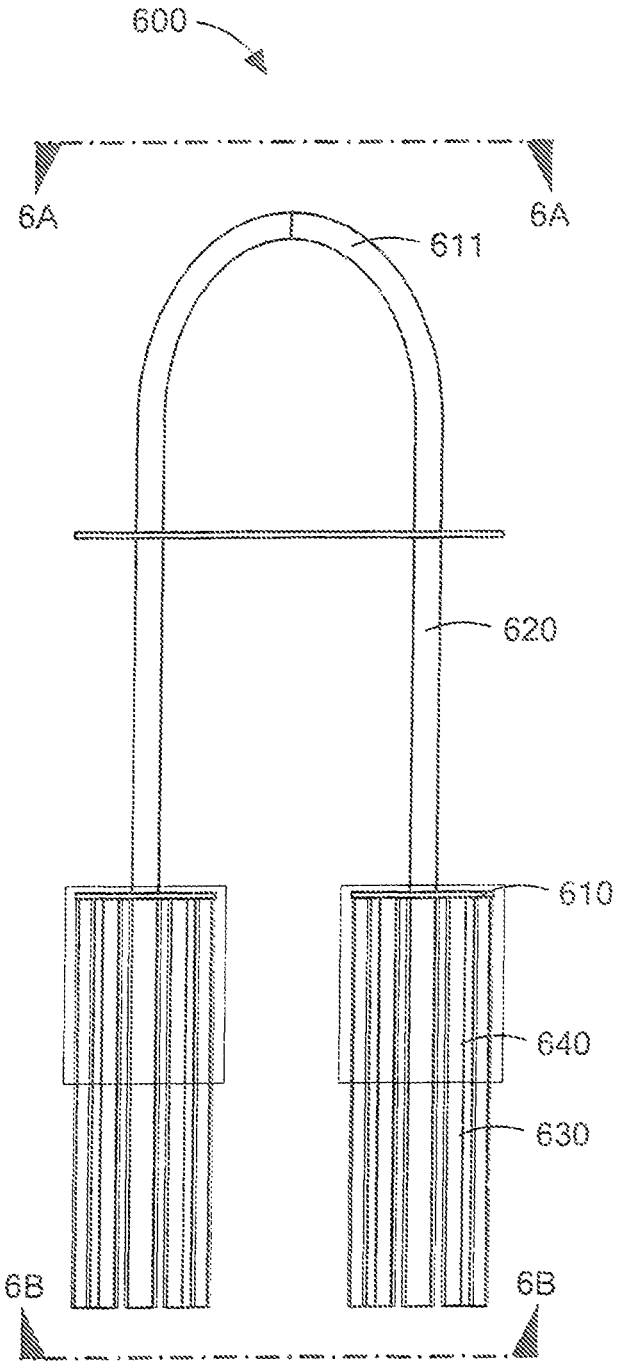
FIGS. 6 and 6A-6C illustrate an application in which a plurality of coaxial RF combiners are coupled input ports of a Multiple-Input Loop Antenna (MILA) according to an embodiment of the present disclosure.
Figure 6A:
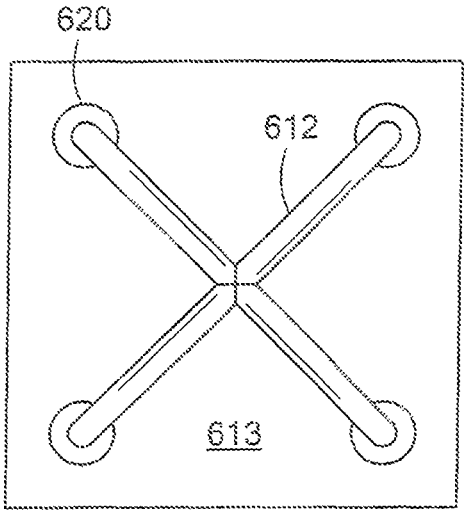
Figure 6B:
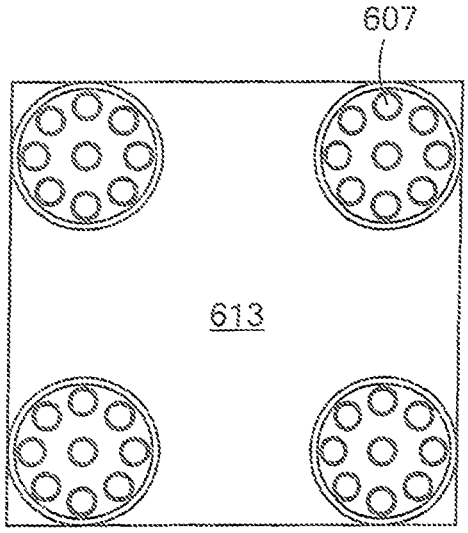
Figure 6C:
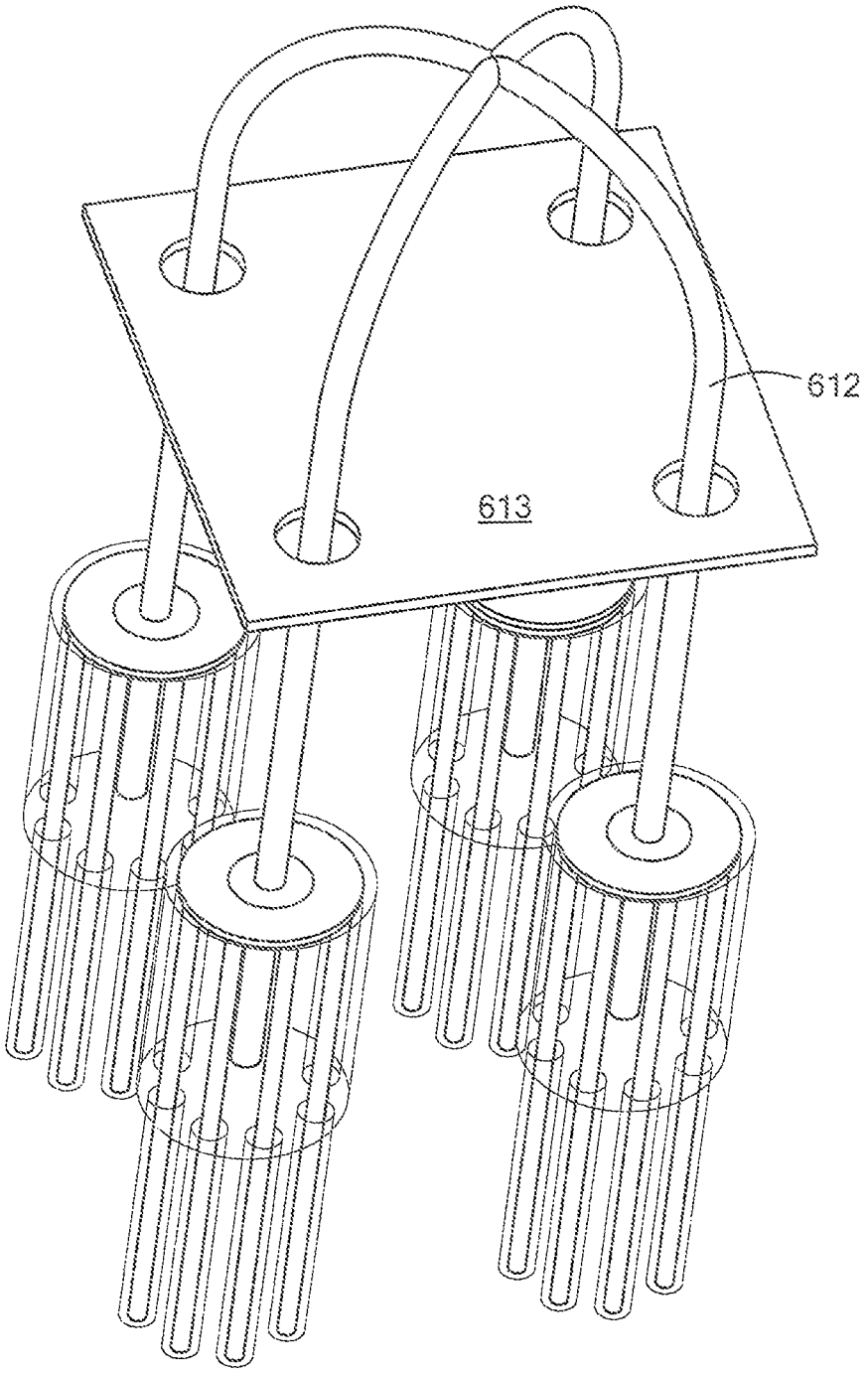

Referring now to FIGS. 6-6C, four eight-way combiners/dividers which may be the same as or similar to the combiner/divider of FIG. 1, are used to drive the inputs of a four-input Multiple-Input Loop Antenna (MILA). In this MILA application, the matching plate 610 is located near the top of the matching cavity 640 although in other embodiments, the matching plate may be located away from the top of the matching cavity. Matching plate 610 connected on one side to coaxial line 620 and on the other side to input coaxial lines 630. Radiating element 612 is disposed over a ground plane 613 which is here provided as a conductive square sheet 613 having dimensions λ/2 on aside at 800 MHz (λ=14.76").

FIG. 6A illustrates a top view of antenna 600 and FIG. 6B illustrates a bottom view of antenna 600 and shows the inner conductors 607 of each input coaxial line A four-input MILA antenna can radiate either of two orthogonal linear polarizations as well as right-hand or left-hand circular polarization by controlling the input phases. For more than four inputs, linear polarization is possible only if the power at some of the inputs is reduced. The configuration shown in FIGS. 6-6C is advantageous as it facilitates a high degree of power combining while maintaining the polarization diversity of the MILA. As the antenna and the power combiners all fit within a half-wavelength footprint, a configuration like that shown in FIGS. 6-6C is compatible with phased array lattice spacing. Electronic beam steering can be realized if phase control is exercised over each of the four antenna inputs (e.g. by coupling a phase shifter between combiners 610 and the antenna inputs).

Figure 7:
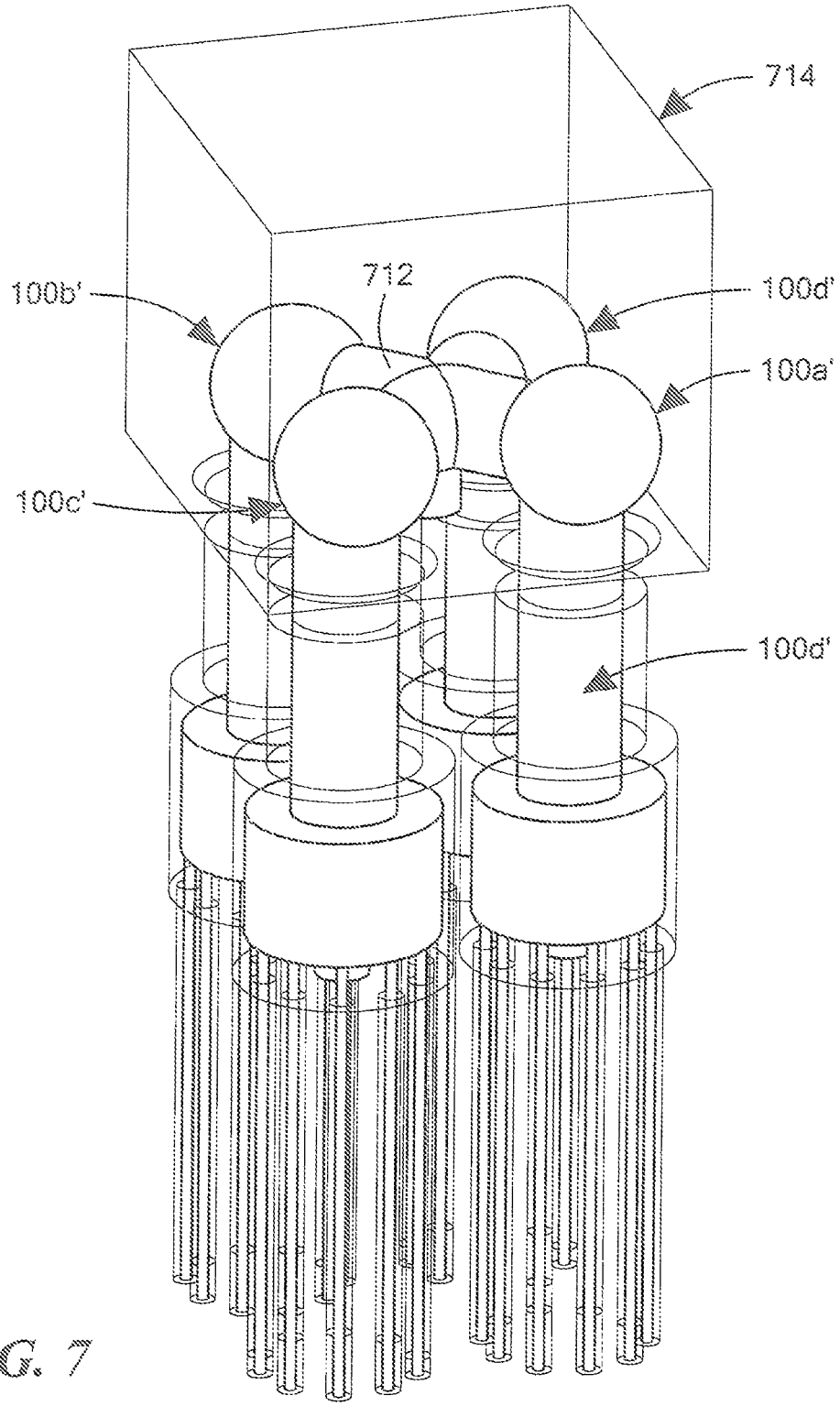
FIGS. 7 and 7A illustrate an embodiment in which four ten-way coaxial RF combiners are coupled to drive the inputs of a MILA.
Figure 7A:
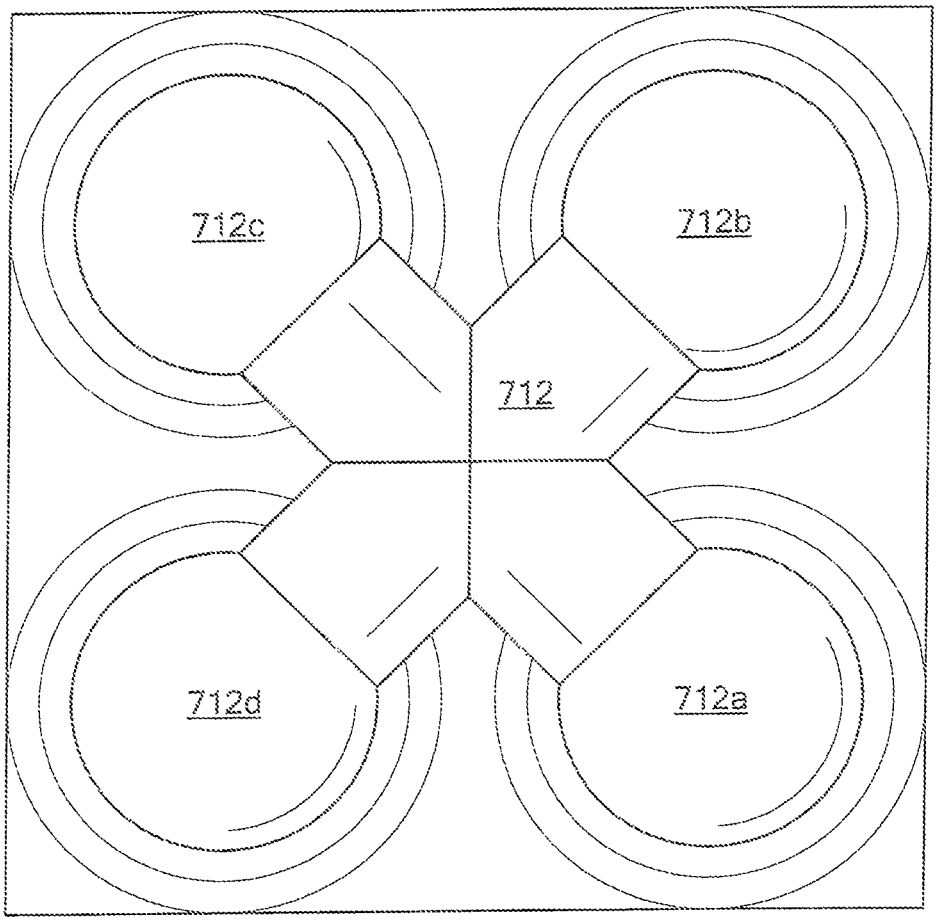

Referring now to FIGS. 7 and 7A in which like elements are provided having like reference numerals, a plurality of coaxial RF divider/combiners 100*a*', 100*b*', 100*c*', 100*d*' are coupled to antenna elements 712*a*-712*d* to form an antenna 712 and the combiners/dividers thus act as a feed to the antenna elements 712. Each coaxial RF divider/combiner may be the same as or similar to the divider/combiner described above in conjunction with FIGS. 1-5.

Figure 8:
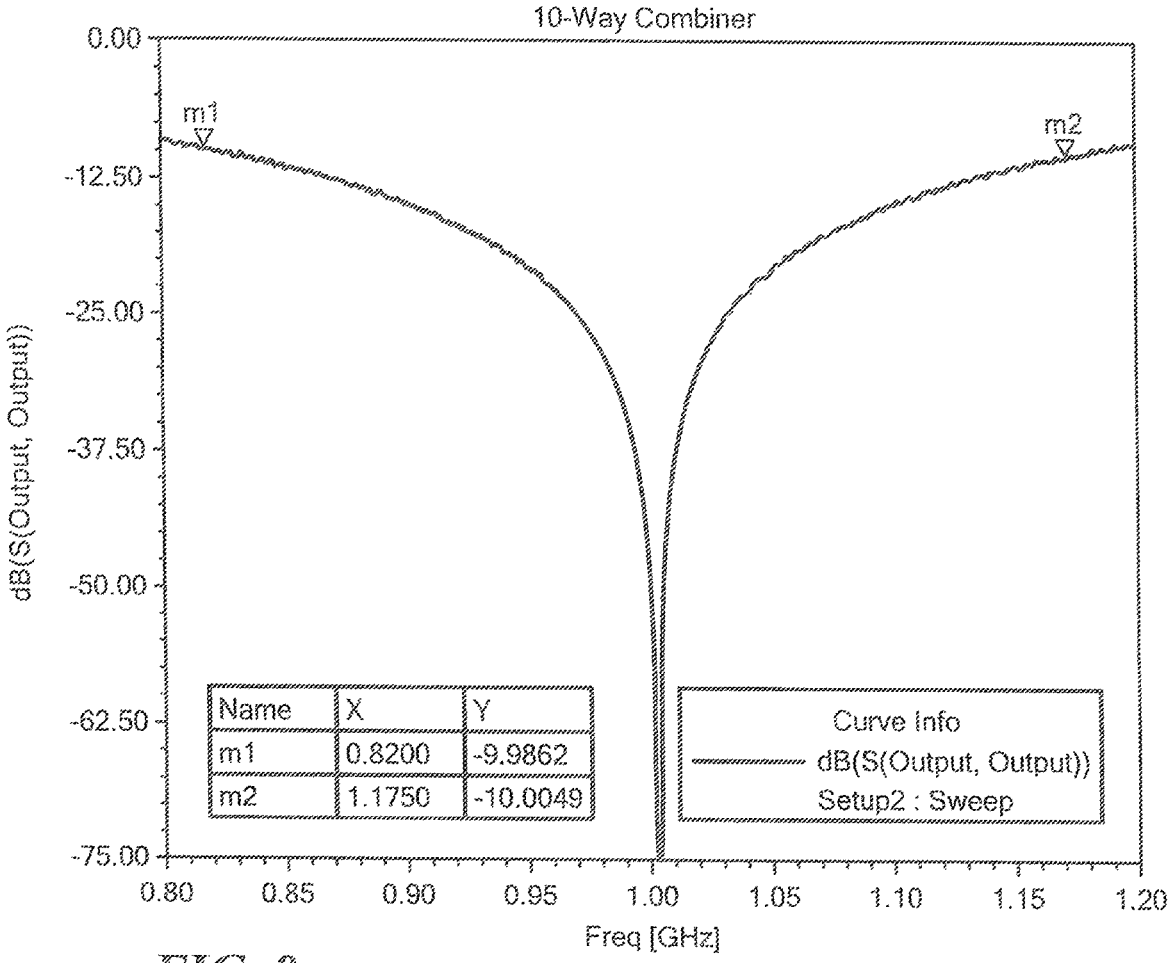
FIG. 8 is a plot of output port return loss versus frequency at an output port of a coaxial RF combiner which may be the same as or similar to the coaxial RF combiner of FIG. 1.

Referring now to FIG. 8, shown is a simulated performance curve of return loss for an example design of one embodiment which may be the same as or similar to the embodiment of FIGS. 7-7A. Each of ten input coaxial lines have 30Ω impedance and uses 0.2" inner conductor diameter. The output coax is a 20Ω line with 1.4" inner conductor diameter. As shown in FIG. 8, the ten input power combiner/divider has $|S_{11}|<-10$ dB over a 35% bandwidth. The transverse dimension is 2.8" in diameter (<λ/4 at 1 GHz) and is compatible with the anticipated array lattice spacing.

Figure 9:
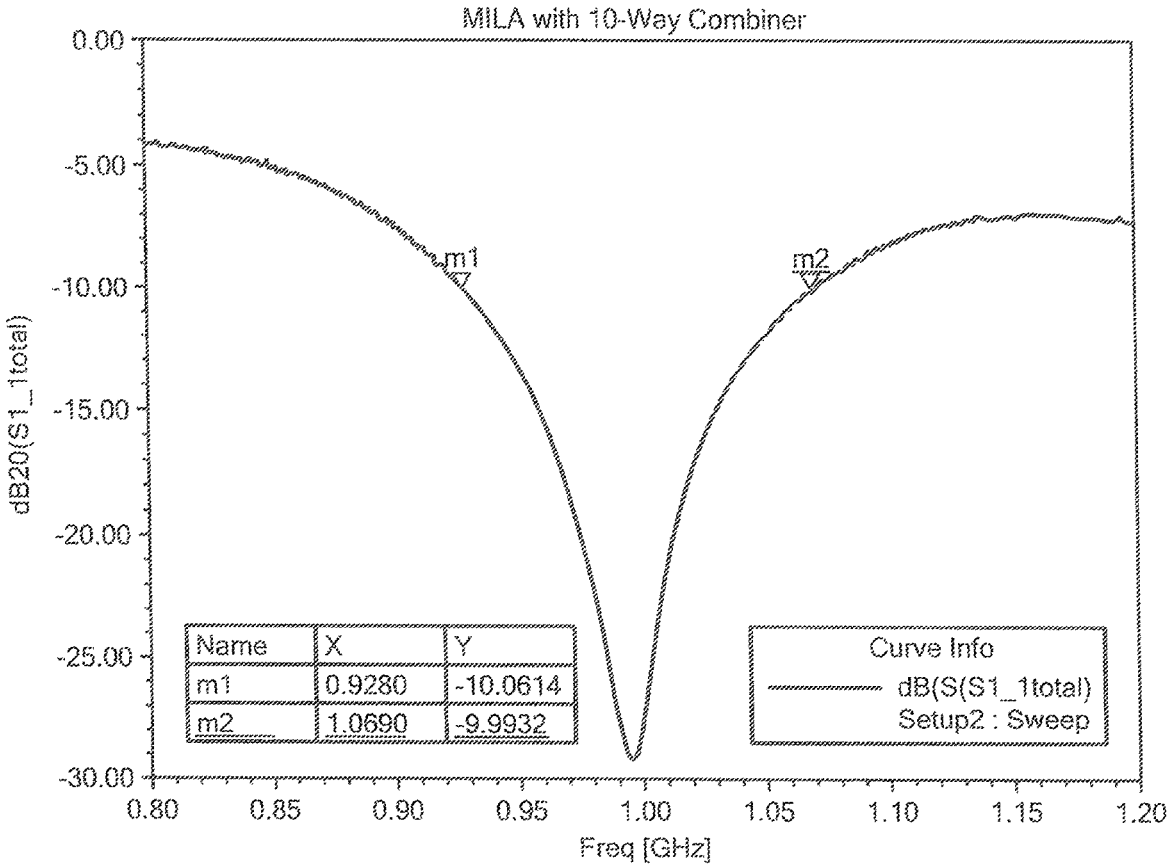
FIG. 9 is a plot of return loss versus frequency for an antenna system comprising MILA having four ten way coaxial-to-coaxial RF combiners are coupled to drive inputs to a MILA, according to an embodiment of the present disclosure.

Referring now to FIG. 9, shown is a simulated result of a four-way MILA using four 10-way power combiners/dividers which may be the same as or similar to the combiner/divider of FIGS. 7-7A. With the same 10 dB return loss, the resulting combined bandwidth (combiner+antenna) is about 14%, yielding substantial radiated power.

Those of ordinary skill in the art will also appreciate that the various power combiners provided in accordance with the concepts described in this patent application may utilize dielectric-filled input transmission lines, output transmission line, and dielectric-filled cavity in any combination (e.g. the cavity can be fully or partially filled). Those skilled in the art will further appreciate that a wide variety of different impedance transformations may be implemented by appropriate selection of cavity dimensions, matching plate dimensions, and coaxial line dimensions as well as selection of dielectric loading material (if any) used. Furthermore, the interior of the power combiner/divider may be evacuated or filled with a gaseous dielectric such as sulfur hexafluoride ($SF_6$) to increase the peak power-handling capability and meet the maximum electric field limitations. Alternatively still, a liquid dielectric may be used.

Figure 10:
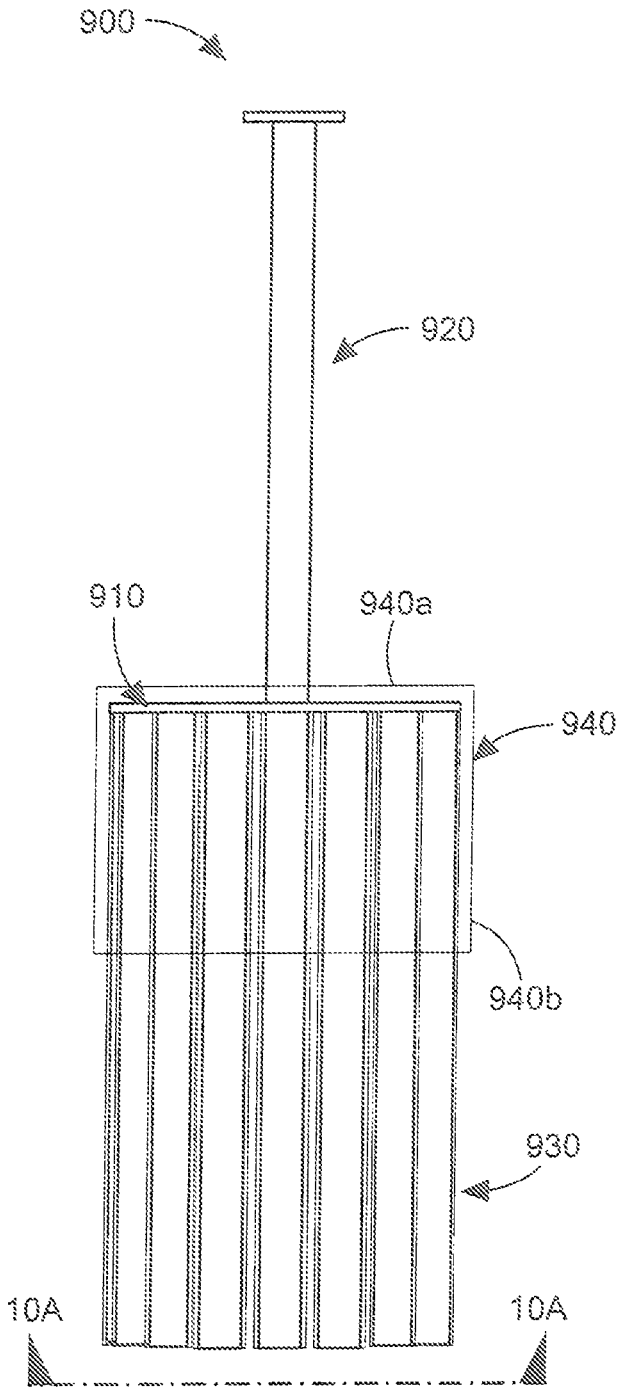
FIG. 10 is a side view of a sixteen way coaxial RF power combiner/divider according to an embodiment of the present disclosure.
Figure 10A:
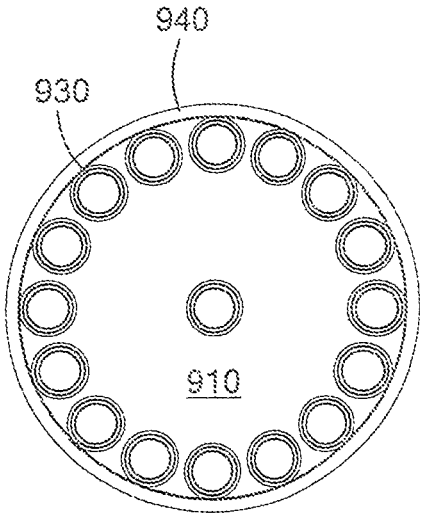
FIG. 10A is a bottom view of the coaxial RF combiner/divider of FIG. 10.
Figure 10B:
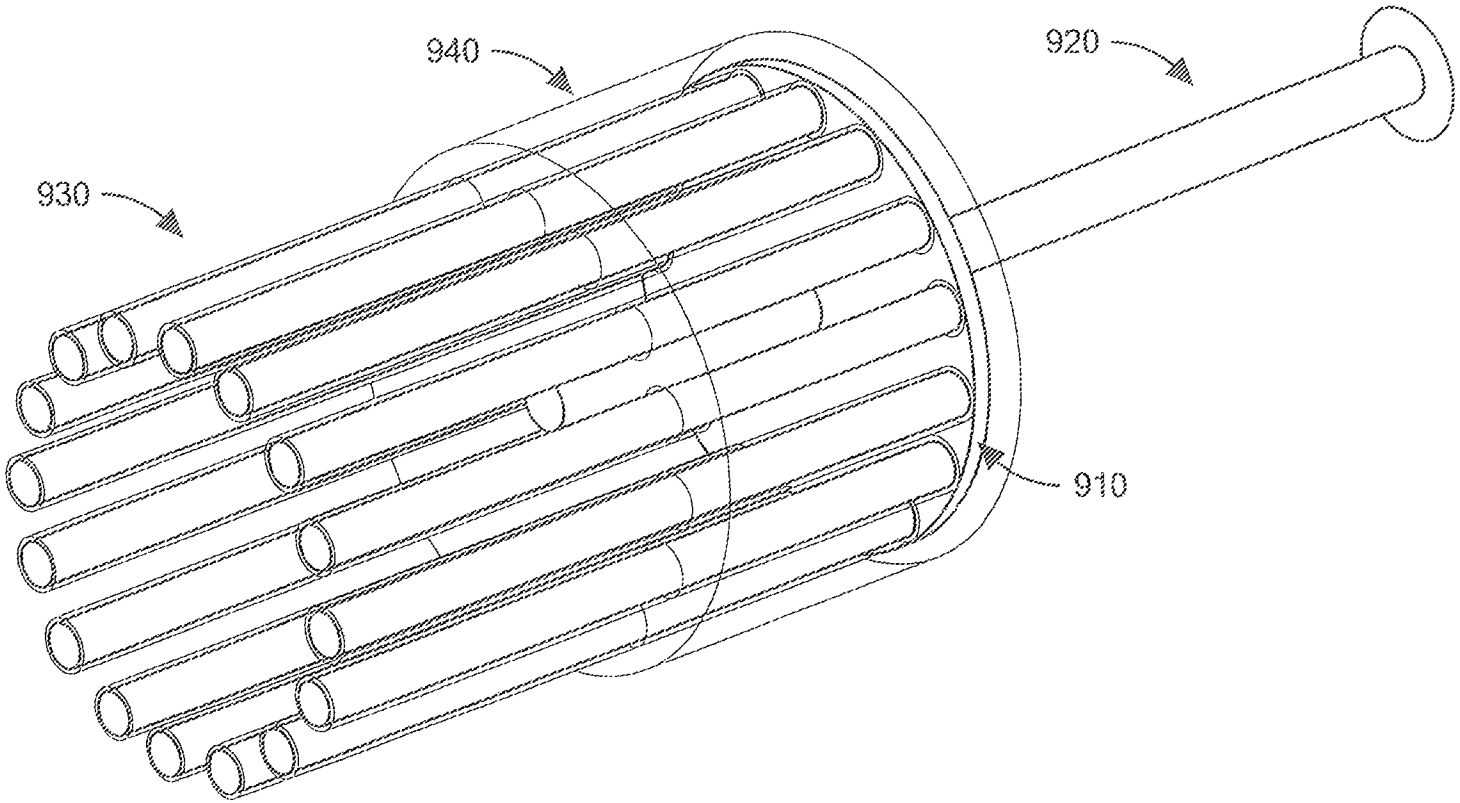
FIG. 10B is an isometric view of the coaxial RF combiner/divider of FIG. 10.

Referring now to FIGS. 10-10B, a sixteen-way impedance-transforming power combiner/divider 900 includes sixteen individual coaxial input lines corresponding to coaxial inputs 930. The inner conductors of the coaxial inputs are electrically coupled to a matching plate 910 disposed inside a matching cavity 940 (shown as being transparent in FIGS. 10-10B). An inner conductor 920 of an output coaxial line is also electrically coupled to the matching plate 910. A bottom surface of matching plate 910 is visible in FIG. 10A.

An embodiment of this power combiner was designed to operate at a center frequency of 800 MHz. The input and output coaxial transmission lines are the same as or similar to those of the eight-way combiner illustrated in FIGS. 3-3B, but in this embodiment, they are centered on a circle with 3.31" in diameter. The cylindrical cavity is 4" in diameter and 3.07" in height. The matching plate is 0.125" thick and 3.78" in diameter. The matching plate is suspended 2.715" above the bottom of the cavity, and is optionally supported by a 0.5" diameter conductive support post.

The performance of the sixteen-way power combiner of FIGS. 10-10B may be calculated as explained below. The sixteen-input effective reflection coefficient $S_{out}$, may be computed as $$S_{out} = 20\log_{10}\left(\left|\sum_{j=1}^{16} S_{1j}\right|\right)$$

In this embodiment, the sixteen-fold rotational symmetry of the combiner substantially ensures that $S_{out}$ is substantially the same for each of the 16 input ports. Computations indicate that the effective return loss is below −10 dB over a 10% bandwidth (with respect to the 800 MHz center frequency) extending from 760.5 to 841 MHz.

Figure 11:
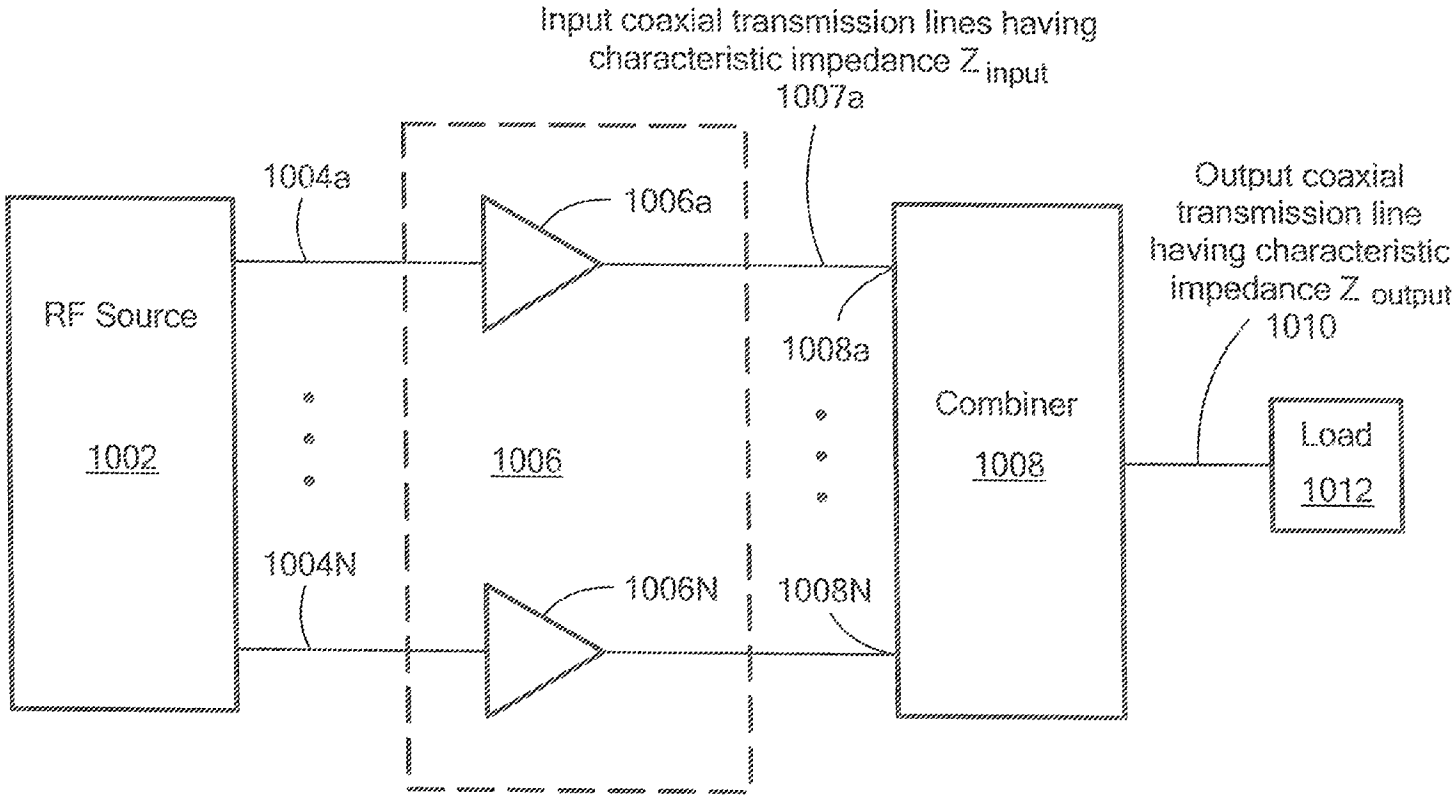
FIG. 11 is a block diagram of an RF system which utilizes a coaxial RF power combiner/divider of the type described herein.

Referring now to FIG. 11, an RF system 1000 includes an RF source 1002 having a plurality of outputs, here N outputs 1004*a*-1004N shown. Each output 1004*a*-1004N is coupled to an input of a respective one of a like plurality of amplification devices 1006*a*-1006N of an amplification circuit 1006. Amplification devices may be provided, for example, as high power amplification devices.

The output of each amplification device 1006*a*-1006N is coupled to a respective one of coaxial inputs 1008*a*-1008N of a combiner 1008. In this illustrative embodiment, amplification devices 1006*a*-1006N are coupled to combiner coaxial inputs 1008*a*-1008N through coaxial transmission lines 1007*a*-1007N having a characteristic impedance matched to both the amplifier output and the combiner input. The output of combiner 1008 is coupled through an output coaxial transmission line 1010.

In one example operating mode, an RF source generates an RF seed signal and delivers four identical signals to the inputs of four amplifiers. The amplifiers can be solid-state amplifiers, Vacuum Electron Device amplifiers (e.g. traveling-wave tubes, klystrons, etc.), or some other type of amplification device. The output of each amplifier is delivered to a coaxial transmission line having characteristic impedance $z_{input}$ through which is delivered power to the input of a power combiner. The output of the power combiner is a coaxial transmission line having characteristic impedance $z_{output}$ which delivers the combined RF power to a load.

The system 1000 illustrates how multiple power combiners can be used to achieve high levels of power combining.

Figure 11A:
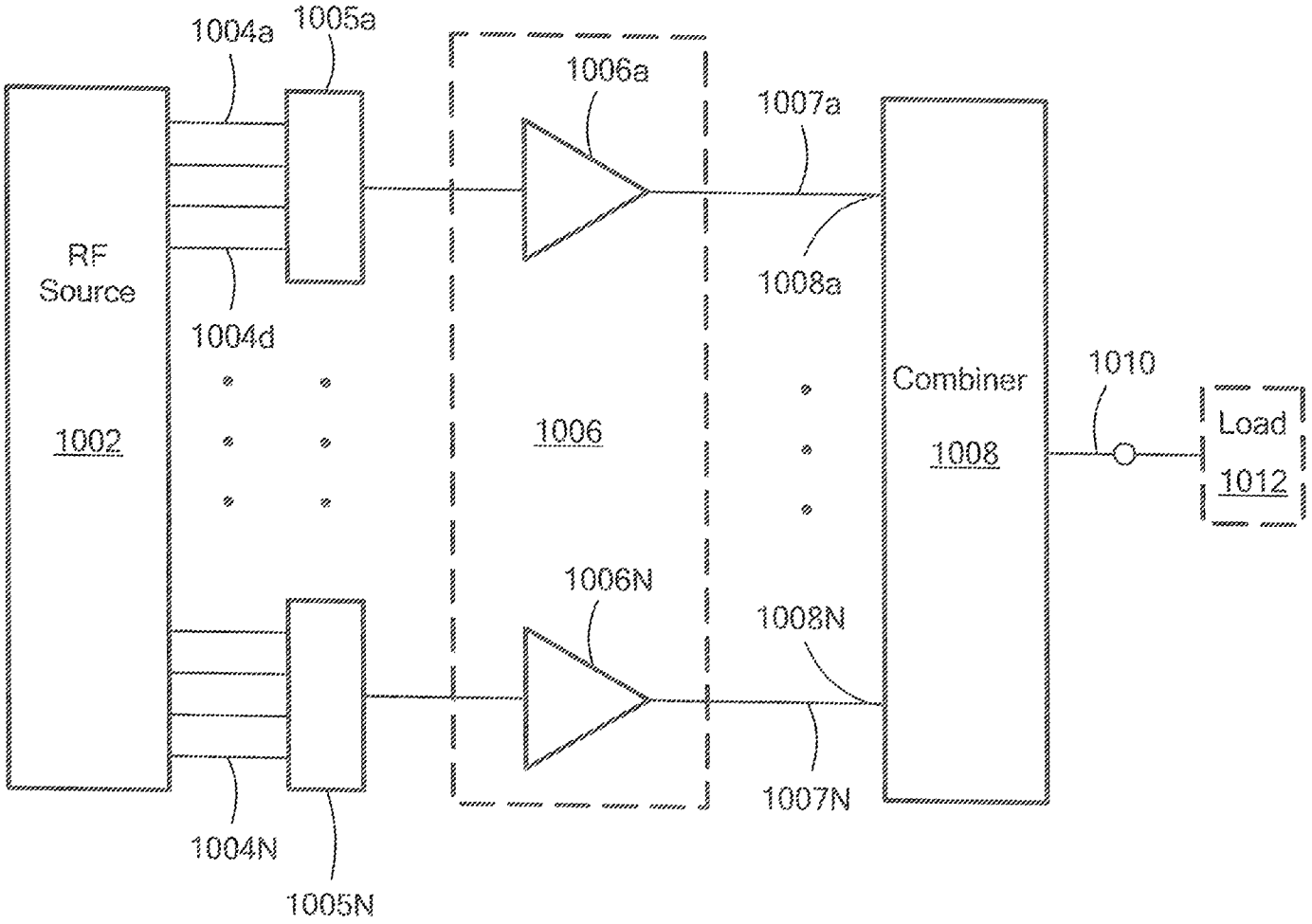

Referring now to FIG. 11A in which like elements of FIG. 11 are provided having like reference designations, shown is an embodiment of an RF system in which multiple inputs from RF source 1002 are combined via combiners 1005*a*-1005N and subsequently provided to respective ones of amplification devices 1006*a*-1006N. Each of combiners 1005*a*-1005N, have multiple inputs which receive signals from RF source 1002.

Figure 12:
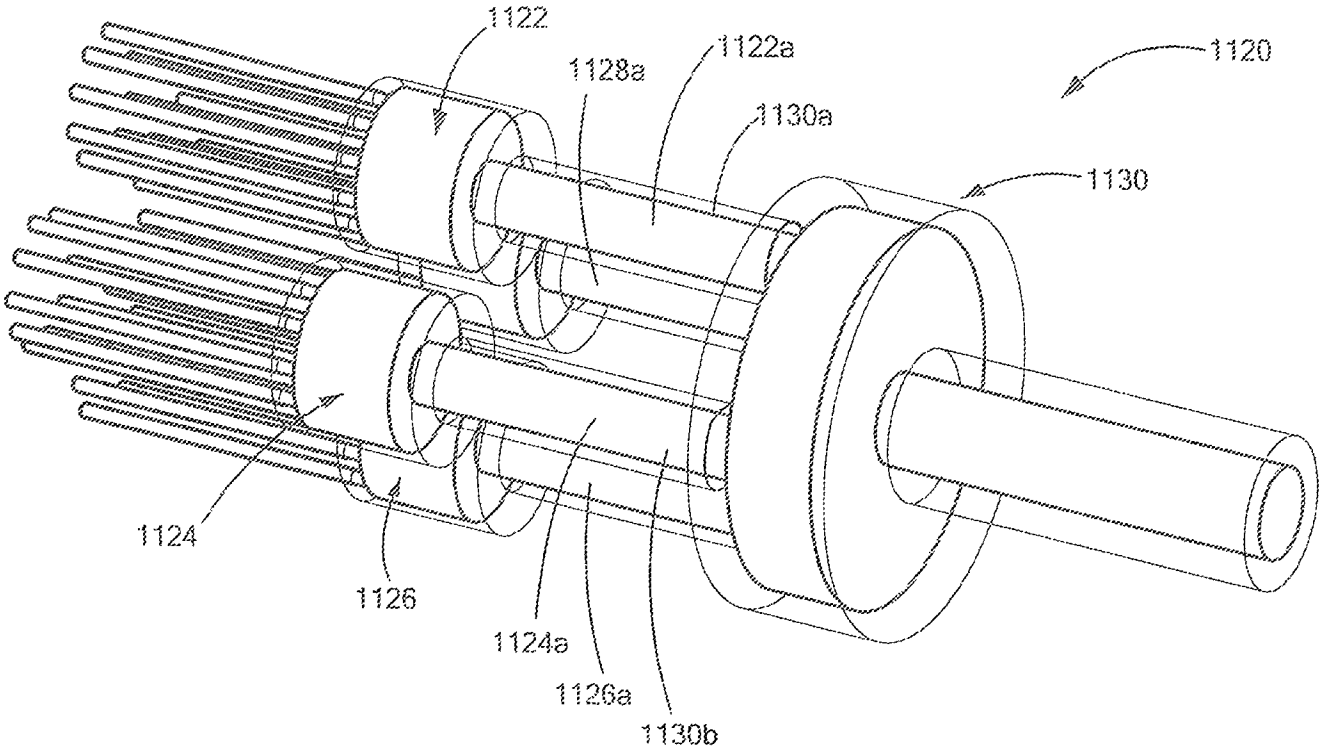
FIG. 12 is an isometric view of four 10-way coaxial RF power combiners/dividers coupled to a single 4-way coaxial RF power combiner/divider.

Referring now to FIG. 12, a coaxial RF combining system 1120 comprises four ten-way (10-way) combiners 1122-1128 with the output of each 10-way combiner 1122*a*, 1124*a*, 1126*a*, 1128*a* is coupled to a respective one of four inputs 1130*a*, 1130*b*, 1130*c*, 1130*d* of a four-way (4-way) combiner 1130. Thus, the outputs of the four 10-way combiners are combined by the single 4-way combiner to realize a 40-1 power combiner It should, of course, be appreciated that the system of combining four power combiners can be extended to combining any number of power combiners. Also, the power combiners can be combined in a flat or hierarchical arrangement or a combination of these two topologies using various power combiners.

The four-way, eight-way, ten-way and the sixteen-way illustrative coaxial RF combiner/divider embodiments presented here are only examples of numerous embodiments covered by the concepts described herein. Numerous different impedance transformations are possible and are anticipated by the concepts described in this patent application. Those of ordinary skill in the art will now appreciate that other power combining/dividing ratios are possible. Combining/dividing ratios as low as two are possible. The upper limit is determined by geometry, i.e., the need to physically fit N transmission lines within the confines of a cavity and matching plate. Those skilled in the art will also appreciate that the power combiner/divider concepts described in this patent application may utilize dielectric-filled input transmission lines, output transmission line, and cavity in any combination. Furthermore, the interior of the power combiner/divider may be evacuated or filled with a solid dielectric of a liquid dielectric or a gaseous dielectric such as sulfur hexafluoride ($SF_6$) to increase the peak power-handling capability.

The power combiners can be configured to match the characteristic impedance of a source (10 ohms, for example) to an antenna feed impedance. This has the advantage of allowing the input transmission lines to be matched to that of the individual sources, while the antenna input impedance may be chosen to minimize peak electric field strength to avoid for example electrical breakdown.

As also described herein a plurality of many power combiners can be combined to drive a large lattice of radiators for phased array and other applications.

The symmetry of the electric field configuration in the region beneath the matching plate allows placement of a conducting rod connecting the underside of the matching plate to ground. Such a conducting rod provides two benefits: (1) It provides mechanical support of the matching plate, and (2) It provides a return path to ground for dc currents, which may be present with certain solid-state source types.

The concepts described herein open up new possibilities in sensors and communications and meet the demands and provides for new approaches in several high energy RF and microwave applications, such as Directed Energy and High Power Microwave (HPM) applications. A modular array of high-power MILA-based elements with power combined feeds could have the capabilities and advantages of short or long pulses, variable PRF (Pulse Repetition Frequency), longer pulse trains, lower voltage operations, lower power operations that enable use of a wider variety of component technologies and provide polarization agility and electronic beam steering to support modern antennas and radars.

Though several embodiments are described here in, it may be desirable in particular configurations to vary the locations of the matching plate, to have different mechanical support structure for the matching plate, to vary the sizes of conductors and the cavity dimensions or to use different dielectrics and insulating materials. These variations known to one in the skilled art are anticipated by the concepts described herein.

Modifications, additions, or omissions may be made to the systems, apparatuses, and methods described herein without departing from the scope of the concepts described herein. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke 35 U.S.C. Section 112(f) as it exists on the date of filing hereof unless the words "means for" or "step for" are explicitly used in the particular claim.

What is claimed is:

1. An impedance matching power combiner structure comprising:

a cylindrical matching cavity, two or more coaxial inputs, each of the two or more coaxial inputs having an inner input conductor and an outer conductor the inner and outer conductors having diameters selected such that said coaxial input is provided having a first selected characteristic impedance;

a coaxial output having an inner conductor and an output conductor the inner and outer conductors having diameters selected such that said coaxial output is provided and having a second selected characteristic impedance a load impedance; and a circular matching plate suspended inside the cylindrical matching cavity, wherein the inner conductors of the coaxial inputs and the inner conductor of the coaxial output are electrically connected to the matching plate;

the outer of the coaxial inputs conductors and the outer conductor of the coaxial output are electrically connected to the cylindrical matching cavity;

a top matching cover plate connected electrically to a top part of the cylindrical matching cavity; and wherein the outer conductor of the coaxial output is electrically connected to the to matching cover plate and the outer conductors of the coaxial inputs are electrically connected to the bottom matching cover plate.

2. The impedance matching power combiner structure of claim 1, further comprising a bottom matching cover plate connected to the bottom part of the cylindrical matching cavity.

3. The impedance matching power combiner structure of claim 1, further comprising a metal post having a top end and a bottom end, wherein the bottom end is attached and electrically connected to the bottom matching cover plate and the top end is electrically connected to and physically attached to the circular matching plate.

4. The impedance matching power combiner structure of claim 1, further comprising a dielectric disposed within the cylindrical matching cavity.

5. The impedance matching power combiner structure of claim 1, further comprising a dielectric disposed within at least a portion of the cylindrical matching cavity.

6. An impedance matching power divider structure comprising:

a cylindrical matching cavity;

two or more coaxial outputs, each of the two or more coaxial outputs having an inner conductor and an outer conductor wherein the inner and outer conductors of each of the two or more coaxial outputs are provided having a diameter such that each of the two or more coaxial inputs have a first impedance characteristic;

a coaxial input having an inner conductor and an outer conductor and wherein the inner and outer conductors of the coaxial input are provided having diameters such that the coaxial input has a second impedance characteristic; and a circular matching plate suspended inside the cylindrical matching cavity, wherein the inner conductor of the coaxial input and the inner conductors of the two or more coaxial outputs are electrically connected to the matching plate;

the outer conductor of the coaxial input and the outer conductors of the two or more coaxial outputs are electrically connected to the cylindrical matching cavity; and the cylindrical matching cavity at least partially matches the first impedance with the second impedance;

a bottom matching cover plate connected to the bottom part of the cylindrical matching cavity; and a metal post having a top end and a bottom end, wherein the bottom end is attached and electrically connected to the bottom matching cover plate and the top end is electrically connected to and physically attached to the circular matching plate.

7. The impedance matching power divider structure of claim 6, further comprising a top matching cover plate connected electrically to the top part of the cylindrical matching cavity.

8. The impedance matching power divider of claim 7, wherein the outer input conductor is electrically connected to the top matching cover plate.

9. The impedance matching power divider structure of claim 6, wherein the outer output conductors are electrically connected to the bottom matching cover plate.

10. The impedance matching power divider structure of claim 6, further comprising a dielectric disposed within at least a portion of the cylindrical matching cavity.

11. The impedance matching power divider structure of claim 6, further comprising a dielectric disposed within the entire cylindrical matching cavity.

12. A multi-stage power combiner comprising:

a first stage comprising a N coaxial power combiners, each of the N coaxial power combiners having M coaxial inputs and a coaxial output; and a second stage comprising a coaxial power combiner having N coaxial inputs with each of the N coaxial inputs coupled to a corresponding coaxial output of the N coaxial combiners in the first stage wherein at least one of the coaxial power combiners comprises:

a cylindrical matching cavity;

two or more coaxial inputs, each of the two or more coaxial inputs having an inner input conductor and an outer conductor the inner and outer conductors having diameters selected such that said coaxial input is provided having a first selected characteristic impedance;

a coaxial output having an inner conductor and an output conductor the inner and outer conductors having diameters selected such that said coaxial output is provided and having a second selected characteristic impedance a load impedance; and a circular matching plate suspended inside the cylindrical matching cavity, wherein the inner conductors of the coaxial inputs and the inner conductor of the coaxial output are electrically connected to the matching plate; and the outer of the coaxial inputs conductors and the outer conductor of the coaxial output are electrically connected to the cylindrical matching cavity;

a top matching cover plate connected electrically to a top part of the cylindrical matching cavity; and wherein the outer conductor of the coaxial output is electrically connected to the top matching cover plate and the outer conductors of the coaxial inputs are electrically connected to the bottom matching cover plate.

13. The system of impedance matching power combiners of claim 12, further comprising in each power combiner, a top matching cover plate connected electrically to the top part of the cylindrical matching cavity and wherein the outer output conductor is electrically connected to the top matching cover plate.

14. A multi-stage power divider comprising:

a first stage comprising a coaxial power divider having a coaxial input and N coaxial outputs; and a second stage comprising N coaxial power dividers, each having a coaxial input coupled to a corresponding one of the N coaxial outputs of said first stage and having M coaxial outputs wherein at least one of the impedance matching power divider structures comprises:

a cylindrical matching cavity;

two or more coaxial outputs, each of the two or more coaxial outputs having an inner conductor and an outer conductor wherein the inner and outer conductors of each of the two or more coaxial outputs are provided having a diameter such that each of the two or more coaxial inputs have a first impedance characteristic;

a coaxial input having an inner conductor and an outer conductor and wherein the inner and outer conductors of the coaxial input are provided having diameters such that the coaxial input has a second impedance characteristic; and a circular matching plate suspended inside the cylindrical matching cavity, wherein the inner conductor of the coaxial input and the inner conductors of the two or more coaxial outputs are electrically connected to the matching plate;

the outer conductor of the coaxial input and the outer conductors of the two or more coaxial outputs are electrically connected to the cylindrical matching cavity; and the cylindrical matching cavity at least partially matches the first impedance with the second impedance;

a bottom matching cover plate connected to the bottom part of the cylindrical matching cavity; and a metal post having a top end and a bottom end, wherein the bottom end is attached and electrically connected to the bottom matching cover plate and the top end electrically connected to and physically attached to the circular matching plate.

15. The system of impedance matching power dividers of claim 14, further comprising in each power divider, a top matching cover plate connected electrically to the top part of the cylindrical matching cavity and wherein the outer input conductor is electrically connected to the top matching cover plate.

16. A method of impedance matching power combining comprising:

inputting source power from two or more sources of coaxial inputs, each of the two or more sources of coaxial inputs having a source impedance and having an inner input conductor and an outer input conductor;

outputting a combined power via a coaxial output having an inner output conductor and an outer output conductor and connected to a load impedance;

matching the source impedance with the load impedance using a cylindrical matching cavity comprising a matching plate suspended inside the cylindrical matching cavity, wherein the inner input conductors and the inner output conductor are electrically connected to the matching plate;

the outer input conductors and the outer output conductor are connected to the cylindrical matching cavity the inner and outer conductors of each of the two or more coaxial inputs have diameters selected such that the coaxial inputs are provided having a first selected characteristic impedance;

the inner and outer conductors of the coaxial output have diameters selected such that the coaxial output is provided and having a second selected characteristic impedance;

the inner conductors of the coaxial inputs and the inner conductor of the coaxial output are electrically connected to the matching plate; and the outer of the coaxial inputs conductors and the outer conductor of the coaxial output are electrically connected to the cylindrical matching cavity;

a top matching cover plate is connected electrically to a top part of the cylindrical matching cavity; and the outer conductor of the coaxial output is electrically connected to the top matching cover plate and the outer conductors of the coaxial inputs are electrically connected to the bottom matching cover plate.

17. A method of impedance matching power dividing comprising:

outputting divided power to two or more sources of coaxial outputs, each of the two or more sources of coaxial outputs having a load impedance and having an inner output conductor and an outer output conductor;

inputting a source power via a coaxial input having an inner input conductor and an outer input conductor and connected to a source impedance;

matching the source impedance with the load impedance using a cylindrical matching cavity comprising a matching plate suspended inside the cylindrical matching cavity, wherein:

the inner input conductor and the inner output conductors are electrically connected to the matching plate; and the outer input conductor and the outer output conductors are connected to the cylindrical matching cavity;

the inner and outer conductors of each of the two or more coaxial outputs are provided having a diameter such that each of the two or more coaxial inputs have a first impedance characteristic;

the inner and outer conductors of the coaxial input are provided having diameters such that the coaxial input has a second impedance characteristic; and the inner conductor of the coaxial input and the inner conductors of the two or more coaxial outputs are electrically connected to the matching plate;

the outer conductor of the coaxial input and the outer conductors of the two or more coaxial outputs are electrically connected to the cylindrical matching cavity; and the cylindrical matching cavity at least partially matches the first impedance with the second impedance;

a bottom matching cover plate is connected to the bottom part of the cylindrical matching cavity; and a metal post has a bottom end attached and electrically connected to the bottom matching cover plate and a top end electrically connected to and physically attached to the matching plate.

18. The method of impedance matching power dividing of claim 17, further comprising in each power divider, electrically connecting a top matching cover plate to the top part of the cylindrical matching cavity and wherein the outer input conductor is electrically connected to the top matching cover plate.

* * * * *